US012103064B2

(12) United States Patent
Staten et al.

(10) Patent No.: US 12,103,064 B2
(45) **Date of Patent: *Oct. 1, 2024**

(54) PUNCH ASSEMBLY WITH INTERCHANGEABLE TIPS

(71) Applicant: E&S Enterprises Inc., Indianapolis, IN (US)

(72) Inventors: Douglas Paul Staten, Indianapolis, IN (US); Donald Carl Edwards, Martinsville, IN (US)

(73) Assignee: E&S Enterprises Inc., Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/570,532

(22) Filed: Jan. 7, 2022

(65) Prior Publication Data

US 2022/0203421 A1 Jun. 30, 2022

Related U.S. Application Data

(63) Continuation-in-part of application No. 16/377,619, filed on Apr. 8, 2019, now Pat. No. 11,235,370.

(51) Int. Cl.
*B21D 5/02* (2006.01)
*B21D 22/02* (2006.01)
(Continued)

(52) U.S. Cl.
CPC ..... *B21D 5/0209* (2013.01); *B21D 22/02* (2013.01); *B21D 37/02* (2013.01); *B21D 37/12* (2013.01)

(58) Field of Classification Search
CPC .. B21D 5/0209; B21D 5/0254; B21D 5/0236; B21D 5/0218; B21D 5/02; B21D 37/12;
(Continued)

(56) References Cited

U.S. PATENT DOCUMENTS 3,782,166 A 1/1974 Whistler et al.
5,638,727 A 6/1997 Gringer
(Continued)

FOREIGN PATENT DOCUMENTS

DE 2608159 A1 9/1977
EP 1321200 A2 6/2003
(Continued)

OTHER PUBLICATIONS

Mate Precision Tooling, retrieving date Dec. 12, 2022. (Year: 2018).*
(Continued)

*Primary Examiner* — Mohammed S. Alawadi
(74) *Attorney, Agent, or Firm* — Maginot, Moore & Beck, LLP

(57) ABSTRACT

A punch assembly with interchangeable tips includes a punch body and a punch tip releasably coupled to the punch body. The punch body includes a proximal end, a distal end opposite the proximal end, and a cross-sectional shape defined between the proximal end and the distal end. The proximal end includes a flange configured to engage a punch holder. The distal end includes a distal surface include a front side and a rear side. At least one first magnet faces a same direction as the front side and at least one second magnet faces a same direction as the rear side. The punch tip is coupled to the distal end of the punch body via a magnetic coupling provided by the at least one first magnet and the at least one second magnet.

20 Claims, 16 Drawing Sheets

(51) Int. Cl.
*B21D 37/02* (2006.01)
*B21D 37/12* (2006.01)

(58) Field of Classification Search
CPC ..... B21D 37/04; B21D 22/02; B21D 28/02; B21D 28/24; B21D 28/246; B21D 28/346; B21D 37/08; B21D 37/10; B21D 37/14
See application file for complete search history.

(56) References Cited

U.S. PATENT DOCUMENTS

| | | | | |
|---|---|---|---|---|
| 6,948,889 | B2 | 9/2005 | Arvidsson | |
| 7,401,491 | B2 | 7/2008 | Leland | |
| 8,322,181 | B2 | 12/2012 | Wilson | |
| 8,752,410 | B2 | 6/2014 | Rogers et al. | |
| 9,975,161 | B2 | 5/2018 | Sato | |
| 10,391,566 | B2 | 8/2019 | Hecht | |
| 2006/0048623 | A1 | 3/2006 | Schneider | |
| 2007/0056348 | A1 | 3/2007 | Leland | |
| 2008/0295566 | A1 | 12/2008 | Hansen | |
| 2011/0247389 | A1* | 10/2011 | Rouweler | B21D 5/0236 72/482.3 |
| 2011/0296969 | A1 | 12/2011 | Lenzotti | |
| 2013/0019650 | A1* | 1/2013 | Rogers | B21D 5/0209 29/428 |
| 2015/0202751 | A1 | 7/2015 | Chen | |
| 2016/0023333 | A1 | 1/2016 | Chen | |
| 2016/0228936 | A1 | 8/2016 | Villeneuve et al. | |
| 2017/0312800 | A1 | 11/2017 | Fischereder et al. | |
| 2018/0071805 | A1 | 3/2018 | Sundquist et al. | |
| 2018/0304331 | A1 | 10/2018 | Cavicchia et al. | |
| 2019/0001387 | A1* | 1/2019 | Sundquist | B21D 37/04 |

FOREIGN PATENT DOCUMENTS

| | | | |
|---|---|---|---|
| EP | 1479461 | A1 | 11/2004 |
| FR | 2791590 | A1 | 10/2000 |
| JP | S53132941 | U | 10/1978 |
| JP | H09220618 | A | 8/1997 |
| JP | 10258329 | A | 9/1998 |
| JP | 2003117607 | A | 4/2003 |
| WO | 2013119380 | A1 | 8/2013 |
| WO | 201871946 | A2 | 4/2018 |

OTHER PUBLICATIONS

International Search Report and Written Opinion in corresponding application PCT/US2020/026894, dated Jul. 27, 2020. (13 Pages).
Mate Precision Tooling, American Precision Style Press Brake Tooling, Mate Precision Tooling (Year: 2018) (44 Pages).
DE 2608159, Machine Translation, Sep. 1977 (Year: 1977) (11 Pages).
Extended European Search Report corresponding to European U.S. Appl. No. 20/786,869, dated Apr. 6, 2023. (10 Pages).

* cited by examiner

PUNCH ASSEMBLY WITH INTERCHANGEABLE TIPS

CROSS-REFERENCE TO RELATED APPLICATIONS

This document is a continuation-in-part of U.S. patent application Ser. No. 16/377,619, filed Apr. 8, 2019, the entire contents of which are incorporated by reference herein.

FIELD

The present disclosure generally relates to the field of bending systems, and particularly to tools and components for press brakes and other sheet forming tools.

BACKGROUND

Manufacturers commonly bend, shape, and cut workpieces with machine presses, press brakes, and punch presses. These, and other force engines, are collectively referred to herein as "presses". As shown in FIG. 1A, a press 10 typically includes a ram 12, such as a hydraulic ram, configured to move relative to a bed 14. The ram 12 usually moves along a vertical axis or horizontal axis toward and away from the bed 14, as noted by arrows 16. Conventionally, presses 10 shape workpieces with a set of tools that may be coupled to the ram 12 and the bed 14. The press 10 of FIG. 1A includes an upper tool in the form of a punch assembly 20 including a punch 24 retained within a punch holder 22. The punch holder 22 is coupled to the ram 12. The press 10 of FIG. 1A further includes a lower tool in the form of a die 18 coupled to or retained within the bed 14. Exemplary workpieces that may be cut, bent, or otherwise formed include sheet metal and other industrial materials.

With reference now to FIGS. 1A and 1B, the press 10, having the vertically displaceable ram 12, bends a workpiece 26 (see FIG. 1B) according to the following exemplary forming process. First, the ram 12 is lifted to an elevated position. Next, the workpiece 26 is placed on the press 10 between the punch 24 and the die 18. After the workpiece 26 is properly positioned, the ram 12 is released from the elevated position. Releasing the ram 12 initiates a downstroke of the press 10 in a press direction (as indicated by arrows 16) so that the ram 12 and the punch assembly 20 move toward the bed 14 and the die 18. As the ram 12 moves toward the bed 14, a surface on a distal end of the punch 24 presses the workpiece 26 against and/or into the die 18 to bend, shape, or form the workpiece. At the completion of the downstroke, the ram 12 is lifted again to the elevated position. The formed workpiece 26 may then be removed from the press 10 by either a user or a machine.

Depending on the end use and size of the workpiece 26, it may be desirable to use any of various differently shaped punches 24 in order bend the workpiece into a desired shape, and to a desired degree, at a desired location. The punch holder 22 releasably retains the punches 24 to allow the operator to exchange different punches in the punch holder 22 for different jobs. However, this process of exchanging punches in and out of the punch holder is time consuming, resulting in increased manufacturing time and cost for each part produced. Additionally, as punches are repeatedly used over time, the tip of the punch wears, resulting in a tool that no longer produces the desired shape. When a punch no longer serves its intended purpose, it must be disposed of and replaced. The cost of repeatedly replacing punches over time further drives up manufacturing costs and time.

In view of the foregoing, it would be desirable to provide a punch assembly for a press that is durable and many be used to provide numerous different shapes. It would be advantageous if such a punch could be used for many different jobs and in association with various workpieces. It would be of further advantage if such a punch could be produced economically and used repeatedly without the need for periodic replacement.

SUMMARY

In at least one embodiment of the disclosure, a punch set includes a plurality of punch bodies, a plurality of magnets, and a plurality of interchangeable punch tips. Each punch body includes a proximal end, a distal end opposite the proximal end, and a cross-sectional shape defined between the proximal end and the distal end. The proximal end includes a flange configured to engage a punch holder. The distal end defines a distal surface elongated in a lateral direction. A press direction is defined perpendicular to the lateral direction and the distal surface. The cross-sectional shape of each punch body is different than the cross-sectional shape of other of the plurality of punch bodies within the punch set. The plurality of magnets are embedded in the distal end of each punch body. The plurality of punch tips are configured to interchangeably and releasably engage the distal end of each punch body. Each punch tip includes a working surface and an opposing groove. The groove on the tip is configured to receive the distal end of one of the punch bodies such that opposing walls of said groove extend past the plurality of magnets embedded in said punch body and such that the plurality of magnets are cupped within the groove when the distal end of said punch body is in said groove. The working surface of each punch tip is defined by a shape. The shape of the working surface of each punch tip is different than the shape of the working surface of other of the other punch tips.

In another embodiment of the disclosure, a punch assembly with interchangeable tips includes a punch body and a punch tip releasably coupled to the punch body. The punch body includes a proximal end, a distal end opposite the proximal end, and a cross-sectional shape defined between the proximal end and the distal end. The proximal end includes a flange configured to engage a punch holder. The distal end includes a distal surface elongated in a lateral direction, wherein a press direction is defined perpendicular to the lateral direction. The punch tip is coupled to the distal end of the punch body via a magnetic coupling provided by a plurality of magnets. The punch tip includes a working surface and a coupling member. The distal end of the punch body engages the coupling member of the punch tip in a tongue-in-groove arrangement, wherein the plurality of magnets are provided within a tongue and cupped within a groove of the tongue-in-groove arrangement.

In yet another embodiment, a method is disclosed for bending a workpiece. The method comprises securing a punch body to a punch holder, the punch body including a proximal end and a distal end opposite the proximal end, the distal end defining a distal surface elongated in a lateral direction, wherein a press direction is defined perpendicular to the lateral direction and the distal surface. The method further comprises magnetically coupling a first punch tip to the distal end of the punch body using a plurality of magnets, the first punch tip having a working surface and an opposing coupling member. Thereafter, the punch body and the coupled first punch tip is moved in the press direction such that the working surface of the first punch tip engages a workpiece. The first punch tip and the workpiece is then forced into a die in the press direction such that the first punch tip bends the workpiece within the die. Next, the punch body and the coupled first punch tip is moved in a direction opposite the press direction such that the working surface of the first punch tip disengages the workpiece. The method further comprises removing the first punch tip from the punch body in order to de-couple the first punch tip from the punch body. Additionally, the method comprises magnetically coupling a second punch tip to the distal end of the punch body, the second punch tip having a working surface and an opposing coupling member.

The above described features and advantages, as well as others, will become more readily apparent to those of ordinary skill in the art by reference to the following detailed description and accompanying drawings. While it would be desirable to provide a method and system for a punch assembly with interchangeable tips that provides one or more of these or other advantageous features as may be apparent to those reviewing this disclosure, the teachings disclosed herein extend to those embodiments which fall within the scope of the appended claims, regardless of whether they include or accomplish one or more of the advantages or features mentioned herein.

DESCRIPTION

Figure 1A:
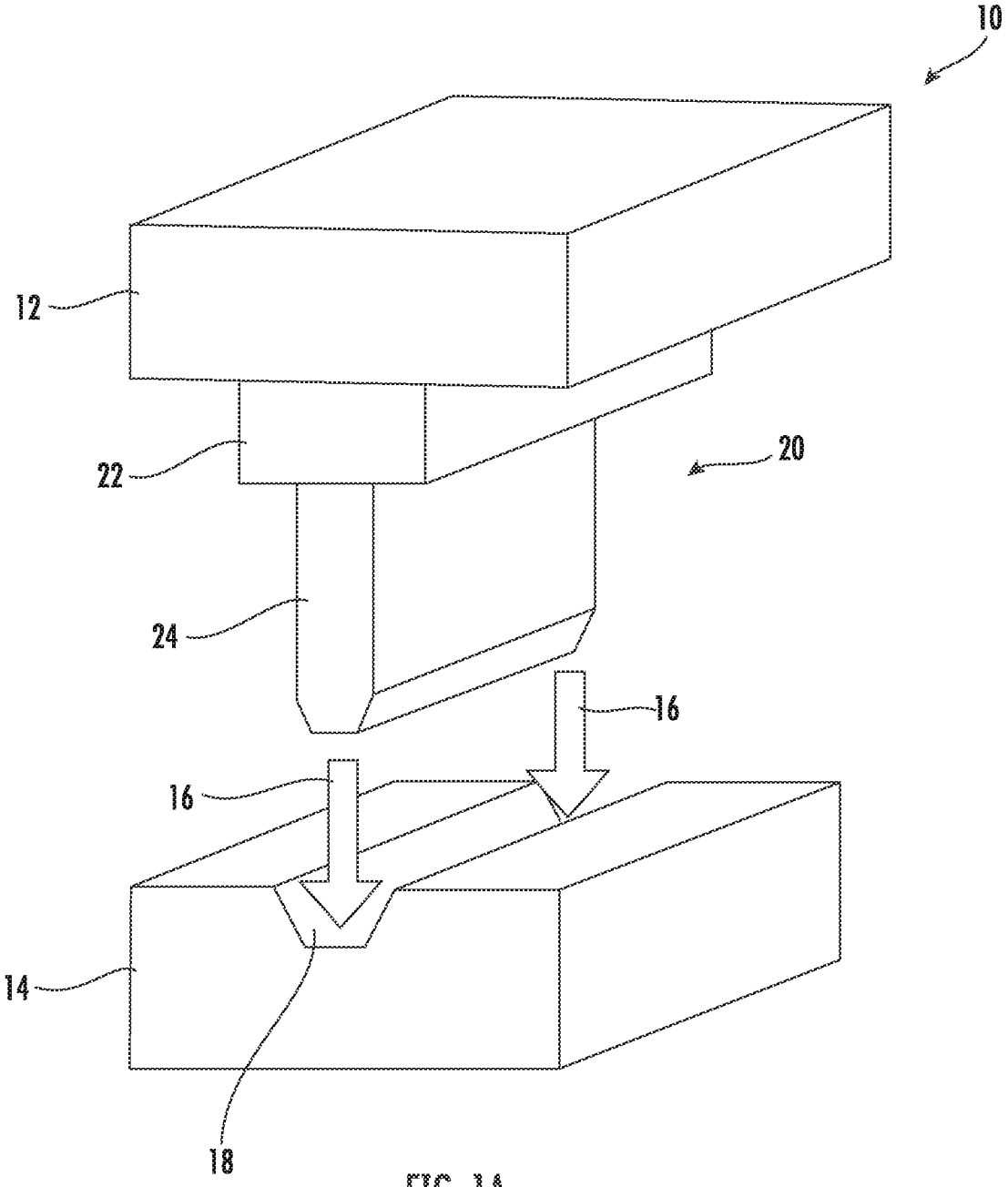
FIG. 1A (PRIOR ART)
FIG. 1A shows a perspective view of a prior art press including a punch assembly and a die.

A punch set is disclosed herein including a plurality of punch bodies and a plurality of interchangeable tips. A plurality of magnets are used to retain the interchangeable tips on the punch bodies. The magnets allow for a releasable magnetic coupling between each of the plurality of interchangeable tips and the plurality of punch bodies. The coupling between the punch body and the interchangeable tip is standard such that each of the interchangeable tips may be coupled to each of the punch bodies. Accordingly, the user may select any combination of tip and punch body within the set to form a punch assembly.

With reference now to FIGS. 2-5, a punch assembly 30 is shown. The punch assembly 30 includes a punch body 40, a plurality of magnets 60, and a plurality of interchangeable tips 70. The punch body 40 is generally a solid, prism-like structure defined by a cross-sectional shape 46 that extends from a left side 50 to a right side 52 of the structure. The punch body 40 is comprised of a relatively strong, hard, ferromagnetic material, such as steel, and is thus capable of withstanding the forces typically produced by the press without deformation of the punch body itself.

The punch body 40 has a uniform cross-sectional shape at all locations on from the left side 50 to the right side 52 of the punch body. The cross-sectional shape 46 of the punch body 40 may be any of various shapes, including polygons or polygon-like shapes. In the embodiment of FIGS. 2-5, the cross-sectional shape is an irregular polygon-like shape that includes at least one curved surface (e.g., a C-shaped surface), but those of ordinary skill in the art will recognize that any of various other shapes are possible and contemplated for other punch bodies. Moreover, in at least some embodiments of the punch body 40, the punch body may not have a uniform cross-sectional shape from the left side to the right side of the structure, but may instead have some irregularities that are designed to produce special bends in workpieces when used in association with a press.

Figure 1B:
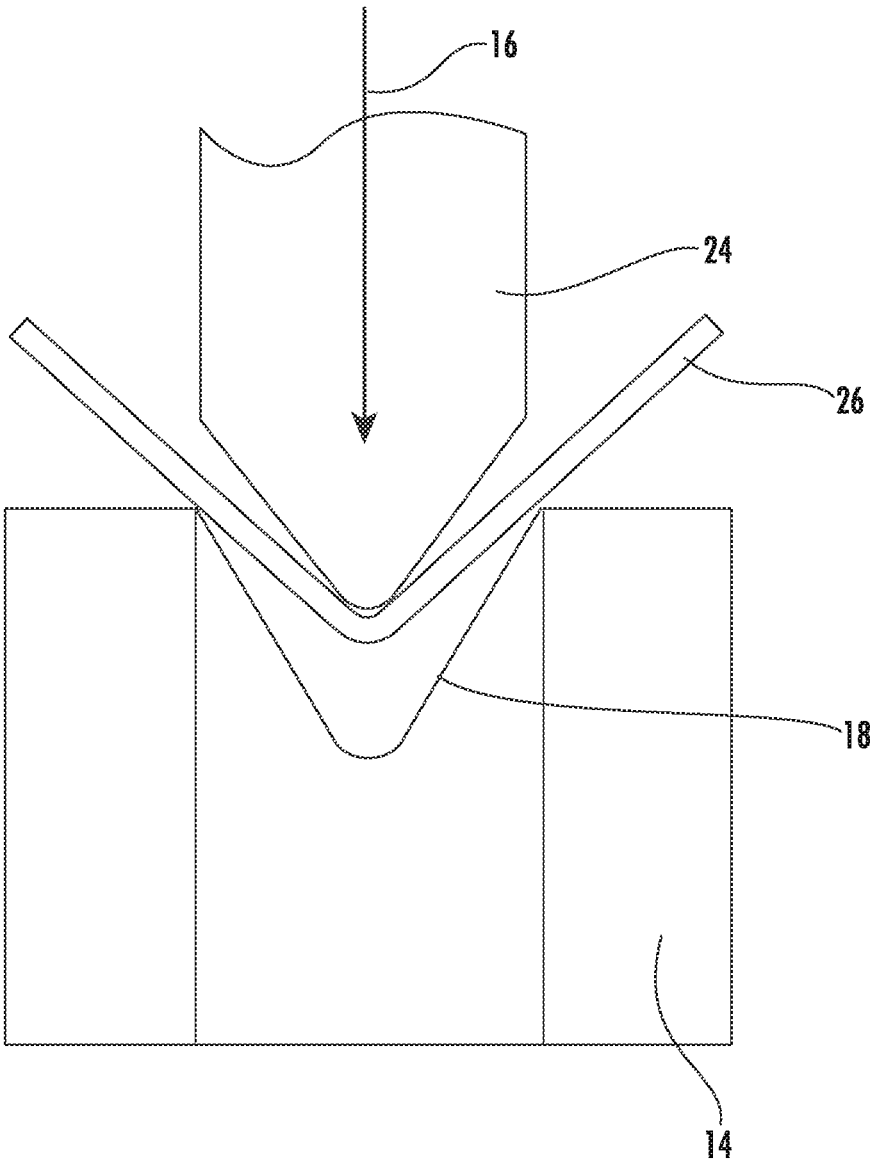
FIG. 1B (PRIOR ART)
FIG. 1B shows a side view of the punch and die of FIG. 1A with a workpiece positioned therebetween.

Each punch body 40 is further defined by a proximal end 42 (which may also be referred to herein as an "upper" end) and an opposite distal end 44 (which may also be referred to herein as a "bottom" end). The proximal end 42 of the punch body 40 includes an upper flange 48 configured to engage a punch holder on a punch press (e.g., see the punch press 10 of FIGS. 1A and 1B). In the embodiment of FIGS. 2-5, the flange 48 is provided by a linear rib structure that projects outwardly from an otherwise flat upper surface on the proximal end 42 of the punch body 40. The flange 48 extends laterally from a left side 50 to a right side 52 of the punch body 40. The flange 48 is positioned slightly offset from the front edge of the punch body such that it is substantially aligned in the vertical direction (noted by arrow 62) with the distal end 44 of the punch body 40 (although not directly aligned, as described in the embodiments of FIGS. 14A-16B, described in further detail below). The structure of the flange 48 is such that a punch holder may clamp onto the flange 48 and fixedly retain the punch body 40 in place upon the press. The punch holder is configured to both retain the flange 48 and translate a downward force from the punch press upon the flange 48 and the upper surface of the punch body 40 located on opposite sides of the flange. While the flange 48 is shown in FIGS. 2-5 as being a linear rib structure that extends laterally across the proximal end 42 of the punch body 40, it will be recognized that other embodiments, the flange 48 may be configured differently, as will be recognized by those of ordinary skill in the art.

The distal end 44 of the punch body 40 is provided by a rectangular prism-like structure with two opposing vertical surfaces 54 and a distal surface in the form of a flat, rectangular bottom surface 56. The vertical surfaces 54 include a front rectangular surface 54*a* and a rear rectangular surface 54*b*, each of which extend downwardly and terminate at the bottom surface 56. The vertical surfaces 54*a* and 54*b* provide a projecting lip or tongue on the distal end 44 of the punch body 40 that is generally aligned with the upper flange 48 in the vertical direction on the punch body 40. In the embodiment of FIGS. 2-5, the vertical surfaces 54*a* and 54*b* are flat and parallel, but it will be recognized that in some embodiments, the vertical surfaces 54*a* and 54*b* may be angled and/or include surface features. For example, the vertical surfaces 54*a* and 54*b* may be substantially vertical (e.g., between 60 and 90 degrees) and/or may include a linear groove.

Figure 10A:
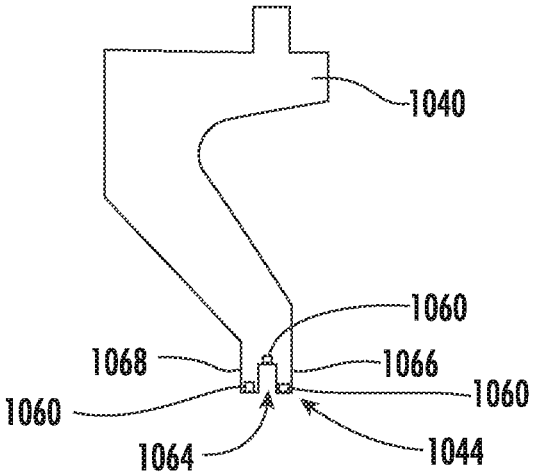
FIG. 10A shows an alternative embodiment of the punch body of FIGS. 2-6.
Figure 10B:
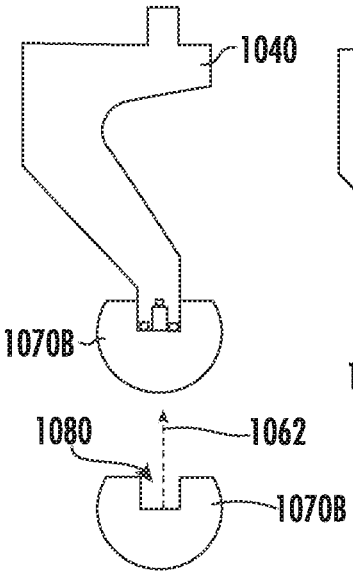
FIG. 10B shows the punch body of FIG. 10A with a first interchangeable tip.
Figure 10C:
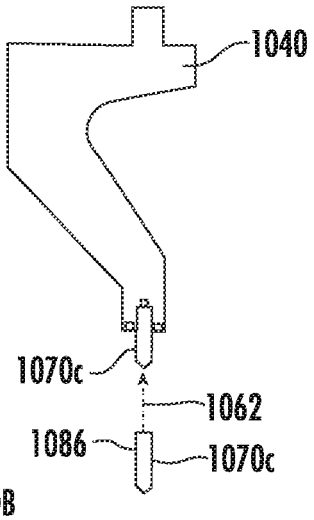
FIG. 10C shows the punch body of FIG. 10A with a second interchangeable tip.
Figure 10D:
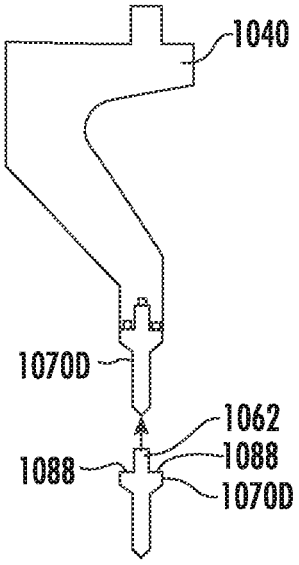
FIG. 10D shows the punch body of FIG. 10A with a third interchangeable tip.
Figure 11A:
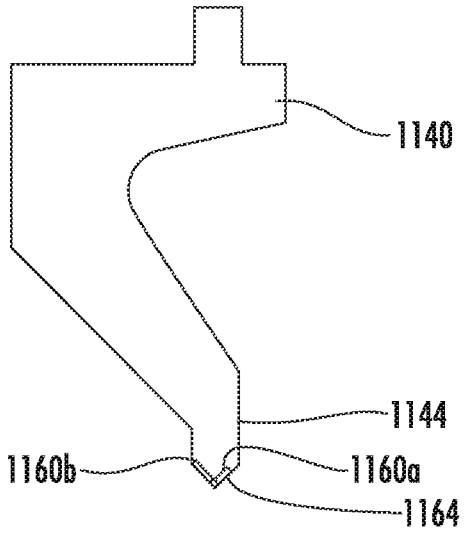
FIG. 11A shows another alternative embodiment of the punch body of FIGS. 2-6.

The opposing vertical surfaces 54*a* and 54*b* of the distal end 44 terminate at the rectangular bottom surface 56. The bottom surface 56 is a distal surface on the punch body 40 and is elongated in the lateral direction (i.e., from the left side 50 to the right side 52 of the punch body). The vertical direction 62 (i.e., the press direction) is defined perpendicular to the lateral direction and a plane in which the bottom surface 56 of the distal end 44 resides. The bottom surface 56 is the surface on the punch body 40 that is configured to apply a downward force. As explained in further detail below, when the punch body 40 is used in association with one of the interchangeable tips 70, the bottom surface 56 of the punch body actually applies the downward force to the associated tip 70. It will be appreciated that the bottom surface 56 may be provided in different forms, such as a flat planar surface (e.g., as shown in FIG. 3), a grooved surface (e.g., as shown in FIG. 10A), or a V-shaped surface (e.g., as shown in FIG. 11A), examples of which are explained and illustrated herein.

Figure 3:
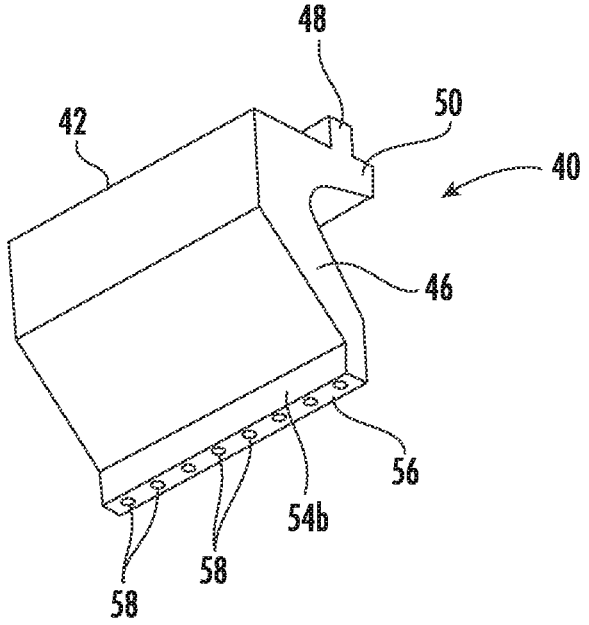
FIG. 3 shows a bottom perspective view of the punch body of the punch assembly of FIG. 2.
Figure 5:
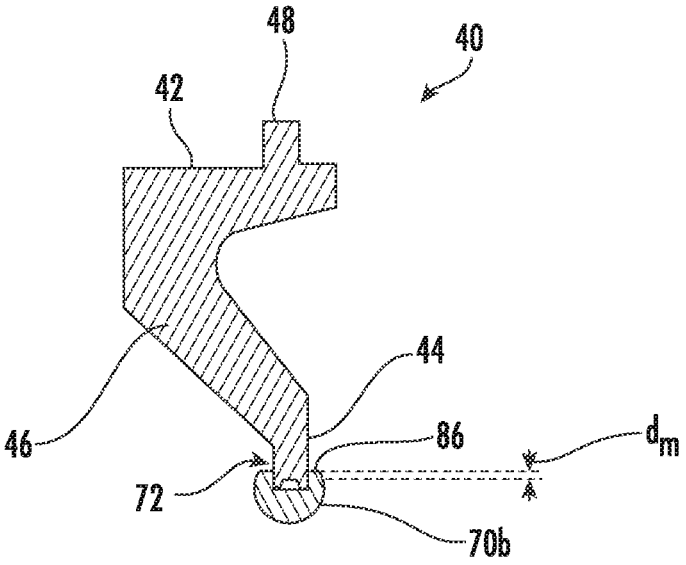
FIG. 5 shows a cross-sectional view of the punch and tip through plane V-V of FIG. 4.

As best shown in FIGS. 3 and 5, a plurality of equally spaced bores 58 or other holes are formed in the distal end 44 of the punch body 40 with bore openings provided in the rectangular bottom surface 56. The bores 58 are aligned in a single left-to-right row on the distal end 44 of the punch body 40, with such row being centered between the front side and the back side of the punch body. Additionally, the leftmost and rightmost bores are positioned close to the left and right edges of the bottom surfaces 56. The magnets 60 are inserted into each of the bores 58. The magnets 60 are capable of retaining one of the interchangeable tips 70 in place on the distal end 44 of the punch body 40. With the bores 58 and associated magnets 60 regularly spaced across a substantial entirety of the bottom surface 56, the attraction of the tip 70 to the punch body is substantially constant from the left side to the right side across the entire tip 70.

The magnets 60 are slightly smaller in diameter than the bores 58, but substantially fill the space formed by the bores 58 when embedded therein. The magnets 60 are retained in place within the bores 58 by any of various means such as adhesives, epoxies, fasteners, friction fit, or other securing means, as will be recognized by those of ordinary skill in the art. The magnets may be any of various types of magnets having relatively strong magnetic properties, and capable of magnetically coupling the punch body 40 and one of the interchangeable tips. For example, the magnets are permanent magnets such as rare earth magnets, which are also known as neodymium magnets. However, it will be recognized that the magnets 60 may also be provided in other forms, such as other types of permanent magnets or electromagnets. Additionally, while the magnets 60 and bores 58 are shown in the embodiment of FIGS. 2-5 as being cylindrical in shape, it will be recognized that the magnets 60 and bores 58 may be differently shaped, such as cubes, rectangular prisms, or other shapes.

With particular reference again to FIG. 2, each of the interchangeable tips 70 is generally a cylindrical or prism-like structure defined by a groove 72 on a proximal side of the tip 70 and a working surface 82 on a distal side of the tip. Thus, the groove 72 provides an opposing surface arranged on an opposite side of the tip from the working surface 82. Each tip 70 is further defined cross-sectional shape 80 that extends from a left side to a right side of the structure. Like the punch body 40, the interchangeable tips 70 are also comprised of a relatively strong, hard, ferromagnetic material, such as steel, and is thus capable of withstanding the forces typically produced by the press without deformation of the tip itself.

Figure 2:
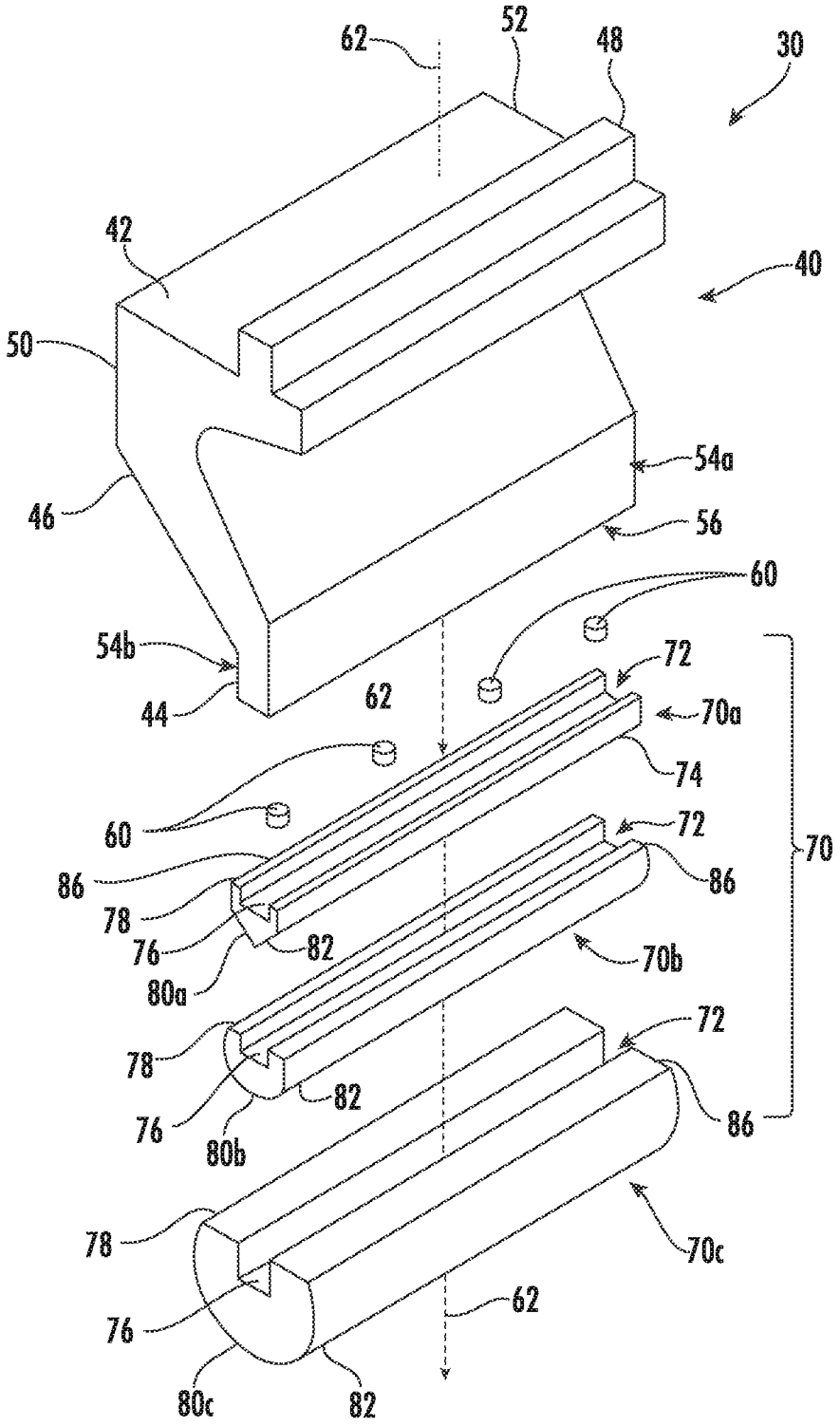
FIG. 2 shows an exploded perspective view of a punch assembly including a punch body and interchangeable tips.

The cross-sectional shapes 80 of the tips 70 may include any of various shapes, including polygons or polygon-like shapes, shapes with curved surfaces such as ovals or circles, or combinations of such shapes. As shown in FIG. 2, a first tip 70*a* has a generally triangular cross-sectional shape 80*a* including an angled portion with two legs extending therefrom and a recess formed between the two legs (i.e., see the left side of the tip 70*a*). A second tip 70*b* has a truncated circular or oval shape 80*b*, including a curved portion and a recess formed on an opposite side of the shape from the curved portion. A third tip 70*c* has another truncated circular or oval shape 80*c* with a larger radius or curved arc than the shape 80*b*, and a recess formed opposite the curved portion. When the cross-sectional shape 80 is translated across the structure from the left side to the right side, the recess is associated with the linear groove 72 formed on the tip 70, and the portion opposite the groove is associated the working surface 82 of the tip 70. Accordingly, the portion of each cross-sectional shape 80 that is associated with the groove 72 is a concave portion, and the portion of the cross-sectional shape that is associated with the working surface 82 is typically a convex portion.

Each groove 72 of a tip 70 is defined by a front wall 74, a bottom surface 76, and a rear wall 78. The shape of the groove 72 is complementary to the shape of the distal end 44 of the punch body 40 such that the distal end 44 of the punch body 40 fits into the groove 72. Accordingly, in the embodiment of FIGS. 2-5, the front wall 74 is parallel to the rear wall 78 and the bottom surface 76 extends therebetween, perpendicular to both the front wall 74 and the rear wall 78. The distance between the front wall 74 and the rear wall 78 is sufficient to allow the distal end 44 of the punch body 40 to be closely received within the groove 72. Furthermore, the depth of the groove 72, as defined by the height of the front wall 74 and rear wall 78 extending from the bottom surface 76 to an upper surface 86 of the front wall 74 or rear wall 78, is sufficient such that a significant portion of the distal end 44 of the punch body 40 may be inserted into the groove 72. For example, in at least some embodiments, the depth of the groove may be between 5 mm and 50 mm. The depth of the groove 72 may also be defined as a ratio relative to the overall height of the tip (e.g., the distance from the center of the working surface 82 to a line extending between the top of the front wall 74 and the rear wall 78). This ratio of the height of the tip 70 to the depth of the groove 72 may be, for example, between 2:1 and 4:1. In at least some embodiments, the height of the tip 70 to the depth of the groove 72 is about 3:1 (e.g., between 2.75:1 and 3.25:1). It has been determined that such a ratio provides good stability for the tip 70 when mounted on the distal end 44 of the punch body 40.

Figure 4:
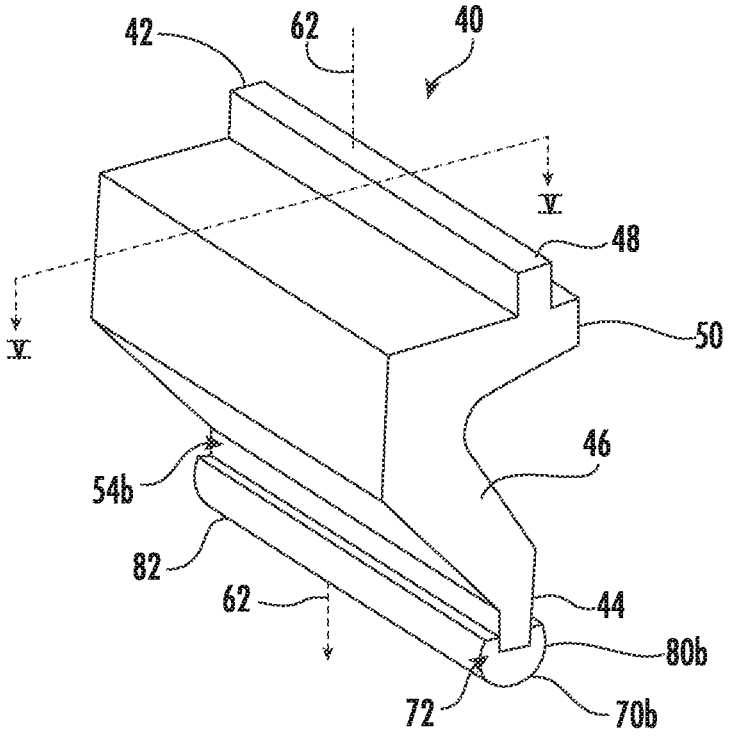
FIG. 4 shows a top perspective view of the punch assembly of FIG. 2 with a tip positioned on an end of the punch body.
Figure 6:
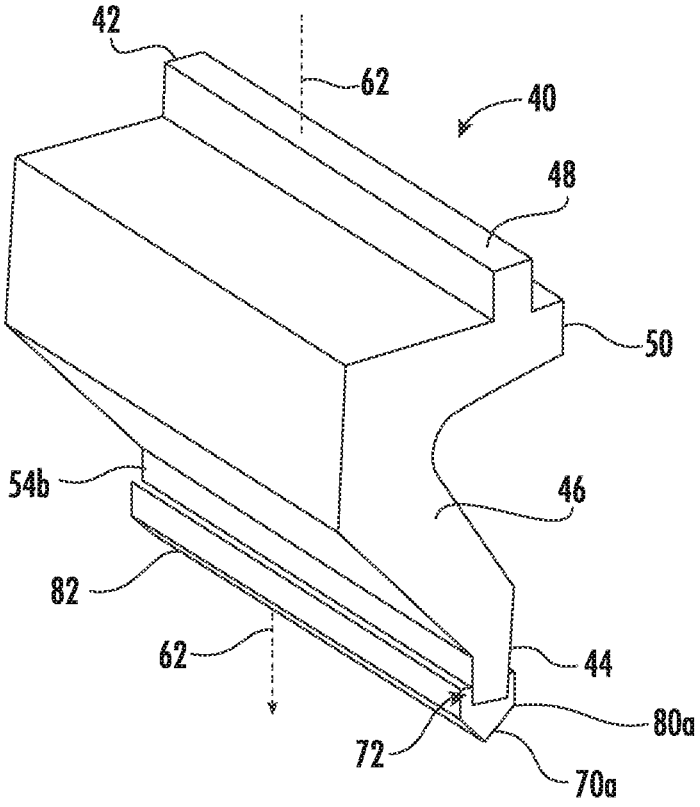
FIG. 6 shows a top perspective view of the punch body of FIG. 4 with an alternative tip positioned on the end of the punch.

The tips 70 are configured to interchangeably engage the distal end 44 of the punch body 40 via the grooves 72. Thus, each of the three tips 70*a*, 70*b*, and 70*c* is configured for placement on the punch body 40. FIGS. 4 and 5 show one of the interchangeable tips 70*b* mounted on the distal end 44 of the punch body 40. FIG. 6 shows a different tip 70*a* of the plurality of interchangeable tips mounted on the same punch body 40. Each of the various tips 70 typically have a significantly lesser height than the associated punch body 40 and are configured for mounting on the distal end 44 of the punch body. Accordingly, the height of each punch body 40 relative to each punch tip 70 in a set of punches and tips will typically fall within a range. For example, the height of a punch body relative to the punch tip for a given punch set is typically between 2.5:1 and 10:1. In at least one exemplary embodiment, the ratio of each punch body to each punch tip in a punch set is between 3.5:1 and 8:1.

When one of the tips 70 is mounted on punch body 40, the distal end 44 of the punch body 40 serves as a tongue that is received within the groove 72 of the tip 70*b* with the bottom surface 56 of the tongue engaging the bottom surface 76 of the groove 72. The opposing front wall 74 and rear wall 78 at the sides of the groove 72 extend upward, past the plurality of magnets 60 embedded in the punch body 40. As a result, the plurality of magnets 60 are cupped within the groove 72 when the distal end of said punch body is positioned in said groove 72 (i.e., as described below, the magnets 60 are below the top surface 86 of the walls defining of the groove 72). The working surface 82*b* of the tip 70*b* is opposite the groove 72 and faces downward. This configuration acts to secure the tip 70 and lock it in place on the punch body 40 (i.e., the tongue-in-groove configuration, wherein the bottom surface 56 of the punch body 40 engages the bottom surface 76 of the groove 72, and the opposing front wall 74 and rear wall 78 extend upward past the magnets 60 as they abut the vertical surfaces 54*a* and 54*b* on the distal end 44 of the punch body 40). Moreover, the magnets 60 provide magnetic forces that attract the tip 70 to the punch body 40 and further secure the tip 70 to the punch body 40. As shown in FIG. 5, when the distal end 44 of the punch body 40 is inserted into the groove 72 of the tip, an upper surface of each magnet 60 is a distance $d_m$ below the upper surface 86 of the tip 70 in which of the magnet 60 is positioned. The distance $d_m$ is greater than zero, and is typically between 1 mm and 20 mm, and helps to further secure the connection between the punch body 40 and the tip 70. In many embodiments the distance $d_m$ is between 3 mm and 6 mm.

Removal of an existing tip 70 from the punch body 40 involves simply pulling the existing tip downward or laterally away from the punch body with sufficient force to overcome the magnetic coupling between the magnets 60 and the tip 70. For example, sliding the tip 70 in the lateral direction such that the distal end 44 of the punch body 40 slides out of the side of the groove 72 will result in removal of the tip 70 from the punch body 40. Similarly, pulling the tip 70 downward will allow the tip 70 to be released from the magnets 60 with the punch body 40 exiting the top of the groove 72. Thereafter, a different tip 70 may be inserted on the punch body 40 in a similar manner.

Figure 7:
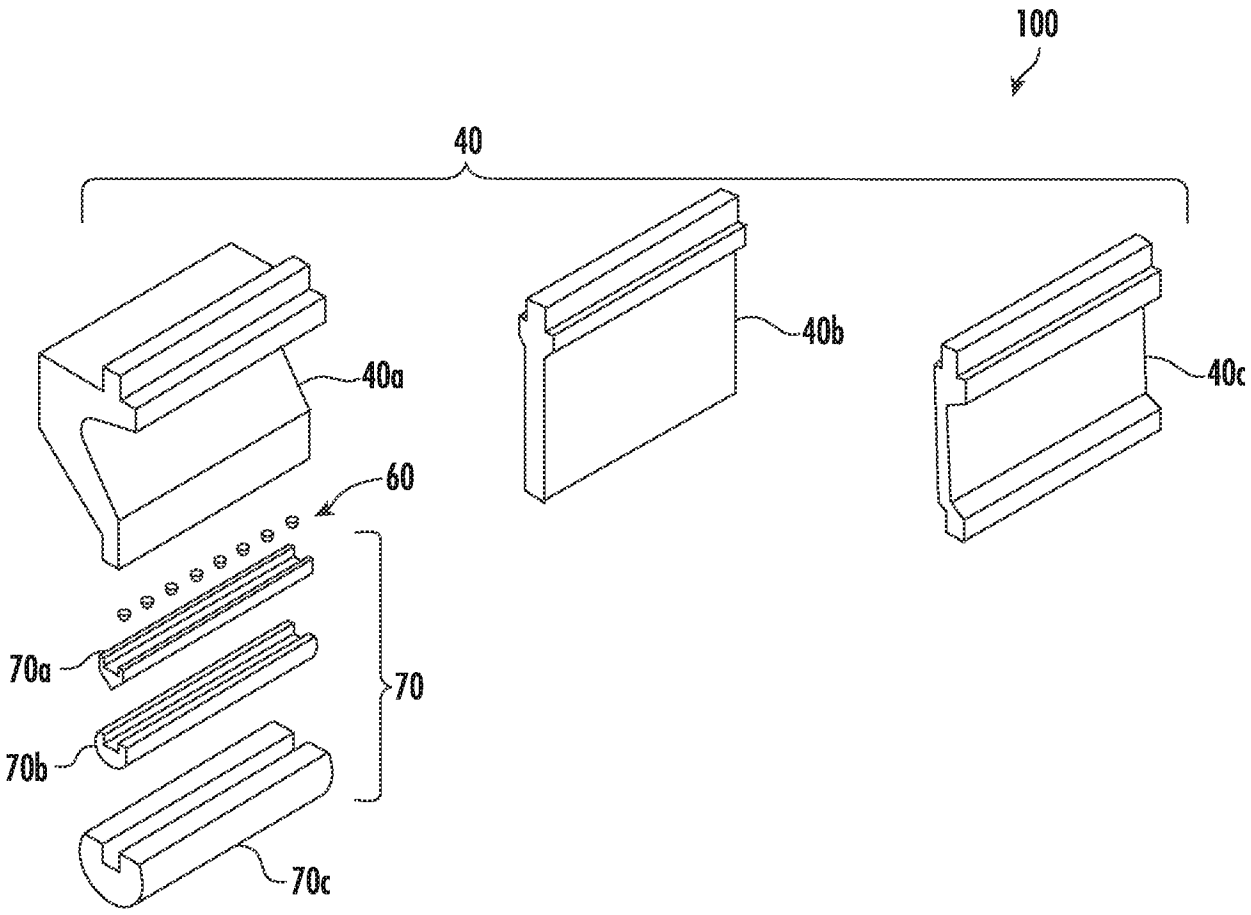
FIG. 7 shows an exploded perspective view of a punch set including a plurality of punches and a plurality of interchangeable tips, such as those of FIG. 2.

In addition to the plurality of interchangeable tips 70 being configured to mount on one punch body 40, it will also be recognized that a plurality of different punch bodies may be provided wherein each of the plurality of interchangeable tips is configured to mount on each of the punch bodies. FIG. 7 shows a punch set 100 including a plurality of differently shaped punch bodies 40*a*, 40*b*, 40*c*, and a plurality of differently shaped punch tips 70*a*, 70*b*, 70*c*. The operator of a punch press with access to the punch set 100 can advantageously use any combination of one of the punch bodies 40*a*, 40*b*, and 40*c* and one of the punch tips 70*a*, 70*b*, and 70*c* in order to form a punch assembly that is capable of producing a desired bend in a workpiece. Additionally, the operator can quickly and easily change punch tips on a given punch, and thus form a different bend in the workpiece with very little time spent adjusting the punch press for the different bend.

In operation, the punch set disclosed in FIGS. 2-7 allows the operator to use any combination of the punch bodies 40*a*, 40*b*, 40*c* and tips 70*a*, 70*b*, 70*c* in order to make a number of desired bends in a workpiece. Accordingly, a method is disclosed herein for bending a workpiece. The method begins when the operator secures one of the punch bodies 40*a*, 40*b*, 40*c* to the punch holder. The method continues when the operator selects a first one of the punch tips 70*a*, 70*b*, 70*c* and magnetically couples the selected punch tip to the distal end of the punch body using a plurality of magnets. Thereafter, the press is operated such that the punch body and the coupled first punch tip is moved in the press direction. As a result the working surface of the first punch tip engages a workpiece. The first punch tip and the workpiece is then forced into a die (e.g., a die such as the die 18 associated with the press 10 of FIGS. 1A and 1B) in the press direction such that the first punch tip bends the workpiece within the die. Subsequently, the punch body and the coupled first punch tip are moved in a direction opposite the press direction such that the working surface of the first punch tip disengages the workpiece. Next, the operator removes the first punch tip from the punch body in order to de-couple the first punch tip from the punch body. The operator then selects a second punch tip and magnetically couples the second punch tip to the distal end of the punch body. Operation of the press is then repeated in order to make a subsequent bend in the existing workpiece or another workpiece. Thereafter, differently shaped punch bodies and/or tips may be interchanged upon the press at the discretion of the operator to produce desired results. Advantageously, the operator can quickly and easily change punches and punch tips on a given punch, and thus form different bends in various workpiece with very little time spent adjusting the punch press and associated punch assembly.

Figure 8:
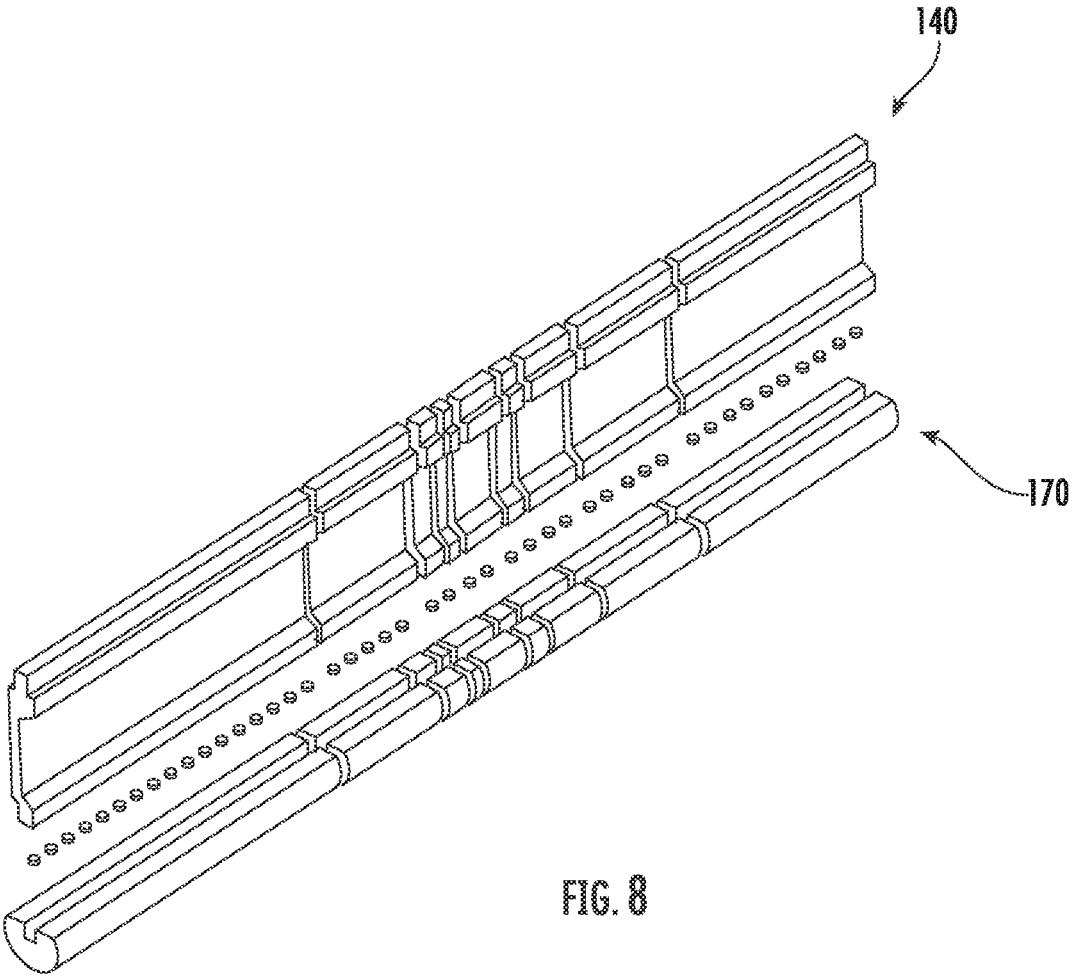
FIG. 8 shows a punch assembly including a series of differently sized punches with interchangeable tips.

With reference now to FIG. 8, in at least one alternative embodiment, the punch set 100 comprises a plurality of punch bodies 140 and punch tips 170, each having the same cross-sectional shape, but each having a different length (i.e., in the lateral direction, from left to right). The configuration of each punch body 140 and each punch tip 170 is similar to that described above in association with FIGS. 2-7. Each length of punch body 140 and the associated punch tip 170 of the same length may be referred to as a "punch section." Because each punch section has a different length, the operator may string together any number of punch sections by placing them side-by-side, thus allowing the user to arrive at a desired combined length for all of the punch sections. This provides the operator with the advantage of being able to produce bends of different lengths when working with various workpieces.

Figure 9:
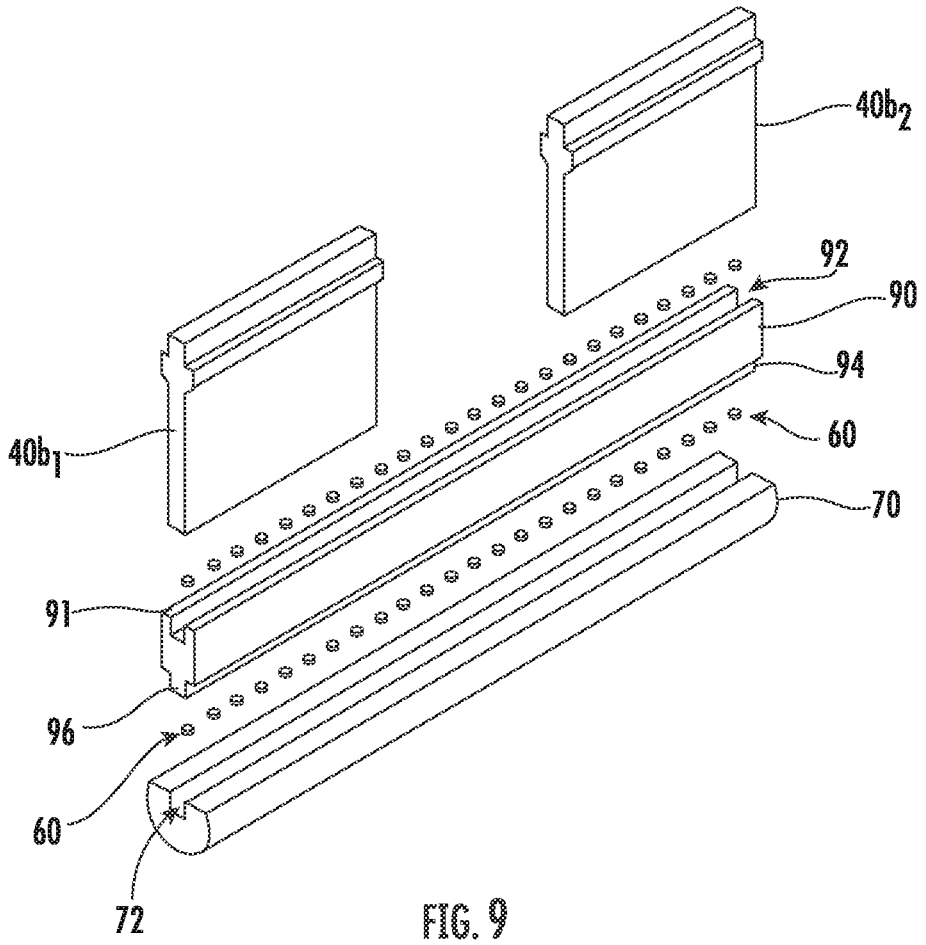
FIG. 9 shows a punch assembly including a pair of punches with a bridge and an interchangeable tip.

With reference now to FIG. 9, in at least one embodiment, the punch set 100 comprises a bridge 90 that extends between two different punch bodies 40$b_1$, 40$b_2$ that are separated by a lateral distance. The bridge 90 includes a proximal end 91 with a bridge groove 92, and a distal end 94 with a bridge tongue 96. The groove 92 on the bridge 90 is similar to the groove 72 of the tip, and the tongue 96 is similar to the tongue on the distal end of one of the punch bodies 40. Accordingly, the bridge 90 serves as an adaptor that allows two spaced apart punch bodies 40$b_1$ and 40$b_2$ to receive an elongated tip 70. The groove 92 on the proximal end 91 of the bridge 90 is configured to receive the tongues on the distal ends of a plurality of punch bodies (e.g., 40$b_1$ and 40$b_2$ as shown in FIG. 9) in a magnetic coupling arrangement, similar to that described previously in association with the embodiment of FIGS. 2-7. The bridge 90 also includes a plurality of magnets 60 disposed in bores (not shown) formed in the tongue 96 on the distal end 94 of the bridge 90. The tongue 96 on the distal end of the bridge 90 is configured to be received in the groove 72 on the tip 70. The bridge 90 allows two punch bodies 40$b_1$ and 40$b_2$ to be spaced apart while providing additional support for a tip 70 spanning between the two punch bodies 40$b_1$ and 40$b_2$. This arrangement is particularly beneficial for longer bends to be made in a workpiece because two shorter punch bodies 40$b_1$ and 40$b_2$ may be used in lieu of a longer punch body. The bridge 90 may also be used interchangeably with various differently shaped punches 40. Accordingly, the bridge 90 provides the punch set 100 with even more functionality without only one additional component instead of a number of longer punch bodies.

Although the various embodiments have been provided herein, it will be appreciated by those of skill in the art that other implementations and adaptations are possible. For example, while the magnets 60 and associated bores 58 are shown in the figures and described as being provided in the distal end of the punch body 40, it will be recognized that in at least some embodiments, the magnets 60 may be positioned in the tips 70 with openings to the bores 58 provided in the bottom surface 56 of the grooves 72.

As yet another example, while the tips 70 are shown herein as including a groove 72, in at least one alternative embodiment, the tips 70 may include a flange configured for insertion into a groove on the bottom surface 56 of the punch body 40. In such embodiment, the magnets 60 may be embedded in the flanges of the tips such that the magnets are cupped within the groove on the bottom surface 56 of the punch body.

As still another example of an alternative embodiment, while the tips 70 have been described herein as having a linear rectangular groove, in at least some embodiments, the tongue-in-groove relationship between the distal end of the punch body 40 and the grooves 72 of the tips may be differently configured, such as a dovetail tongue and groove, or multiple tongue and groove arrangements between each punch body 40 and each tip 70. In these and other embodiments, no magnets may be used in the coupling arrangement between the punch body 40 and the tips 70, and the coupling arrangement may be dependent completely on the shape of the coupling.

With reference now to FIGS. 10A-13D, four different alternative embodiments of a punch body and interchangeable punch tips are shown. In each of these embodiments, the coupling arrangement between the punch body and the punch tips is different. FIG. 10A shows a punch body 1040 wherein a lateral groove 1064 is formed on the distal end 1044 of the punch body 1040. The lateral groove 1064 is defined between two opposing walls 1066 and 1068 that extend in the lateral direction. Magnets 1060 are embedded in the distal end of each of the opposing walls 1066 and 1068 as well as the base of the groove (i.e., within a hole formed in the surface defining the proximal side of the groove). The lateral groove 1064 allows the punch body to be used with an even greater number of interchangeable tips. For example, as shown in FIG. 10B, a first interchangeable tip 1070B is shown with a truncated circular or oval shaped cross-section and a groove 1080 formed opposite the curved portion, similar to the tip 70*c* of FIG. 2. The groove 1080 is designed and dimensioned such that the opposing walls 1066 and 1068 of the punch body are received within the groove 1080 when the tip 1070B is aligned with and moved toward the punch body 1040 in the vertical direction as noted by arrow 1062. FIG. 10C shows another example of an interchangeable tip 1070C having a narrow, substantially rectangular cross-section with a small curvature at the distal end of the tip 1070C. The depth of the tip 1070C is sufficiently thin such that a proximal end 1086 of the tip 1070C fits within the groove 1064 in the distal end 1044 of the punch body 1040. FIG. 10D shows a tip 1070D that is similar to the thin rectangular tip of FIG. 10C, but further includes two opposing shoulders 1088 designed and dimensioned to abut the distal end of the punch body 1040 and further stabilize the tip 1070D on the punch body 1040.

Figure 11B:
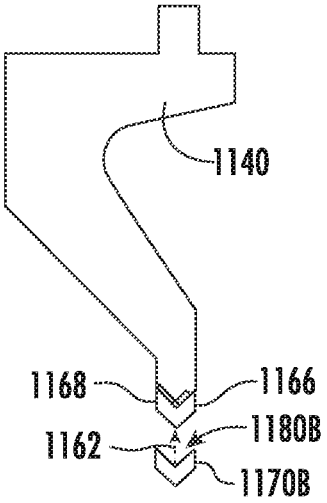
FIG. 11B shows the punch body of FIG. 11A with a first interchangeable tip.
Figure 11C:
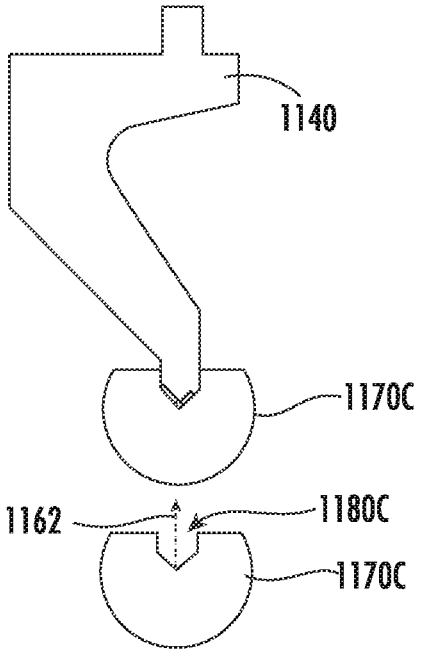
FIG. 11C shows the punch body of FIG. 11A with a second interchangeable tip.

With reference now to FIG. 11A a punch body 1140 is shown wherein the distal end 1144 of the punch body 1140 is tapered (i.e., the front and rear sides are angled inwardly and downwardly) to form a down-ward facing lateral ridge 1164. In other words, the cross-section of the ridge 1164 has an arrow-like shape with a downward pointing vertex. Magnets 1160*a* and 1160*b* are provided on each side of the ridge 1164. The magnets are oriented at an angle relative to one another (e.g., at a ninety degree angle) with a group of first magnets 1160*a* aligned along the front side of the ridge 1164, and a group of second magnets 1160*b* aligned along the back side of the ridge 1164. As shown in FIG. 11B a first tip 1170B includes a groove 1180B that is complementary to the ridge 1164. Accordingly, the groove 1180B is configured to receive the ridge 1164 when the tip 1170B is aligned with and moved toward the punch body 1140 in the vertical direction as noted by arrow 1162. The tip 1170B is also relatively thin such that vertical walls 1166 and 1168 on the front and rear of the tip 1170B are aligned with the vertical walls on the distal end of the punch body 1140. As shown in FIG. 11C, a second tip 1170C has a truncated circular or oval shaped cross-section and a groove 1080C formed opposite the curved portion, similar to the tip 70*c* of FIG. 2. The groove 1180C is also complementary to the ridge 1164 and configured to receive the ridge 1164 therein.

Figure 12A:
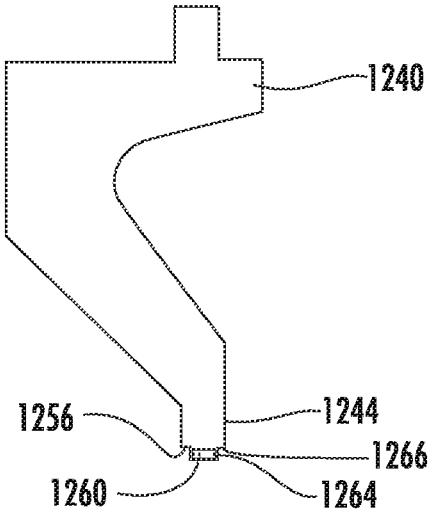
FIG. 12A shows yet another alternative embodiment of the punch body of FIGS. 2-6.
Figure 12B:
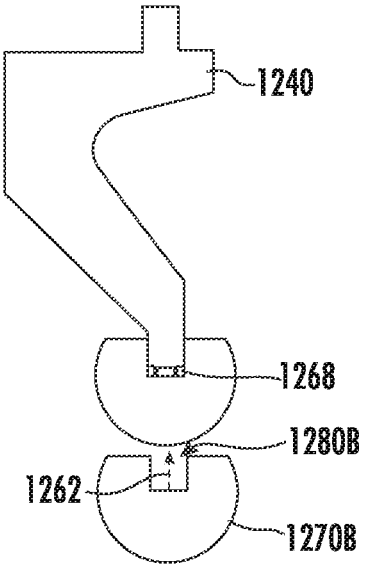
FIG. 12B shows the punch body of FIG. 12A with a first interchangeable tip.
Figure 12C:
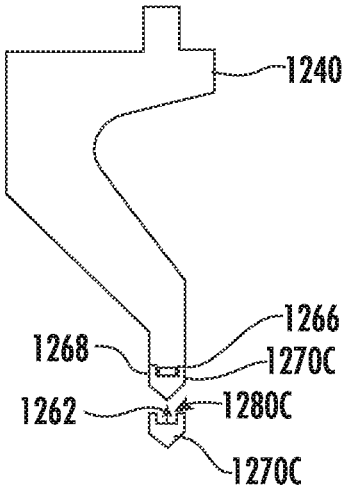
FIG. 12C shows the punch body of FIG. 12A with a second interchangeable tip.

With reference now to FIG. 12A, a punch body 1240 is shown wherein the distal end 1244 of the punch body 1140 includes a lateral rib 1264 formed along the bottom surface 1256 of the punch body 1240. Magnets 1260 are embedded in the distal end 1244 of the punch body 1240 and aligned in the lateral direction along the rib 1264. Shoulders 1266 are formed on the bottom surface 1256 of the punch body 1240 along opposite front and rear sides of the rib 1264. As shown in FIG. 12B, a first tip 1270B has a truncated circular or oval shaped cross-section and a rectangular groove 1280B formed opposite the curved portion, similar to the tip 70*c* of FIG. 2. The groove 1280B is configured to receive the distal end 1244 of the punch body 1240 as noted by arrow 1262. When the first tip 1270B is positioned on the distal end 1244 of the punch body 1240, air pockets 1268 are formed at the shoulder 1266 of the punch body 1240 at the front and rear sides of the rib 1264. FIG. 12C shows a second tip 1270C for use with the punch body 1240. The second tip 1270C includes a groove 1280C that is complementary to the rib 1264. Accordingly, the groove 1280C is configured to receive the rib 1264 when the tip 1270C is aligned with and moved toward the punch body 1240 in the vertical direction as noted by arrow 1262. The tip 1270C is also relatively thin such that vertical walls on the front and rear of the tip 1270C are aligned with the vertical walls on the distal end of the punch body 1140 (i.e., at the shoulders 1266).

Figure 13A:
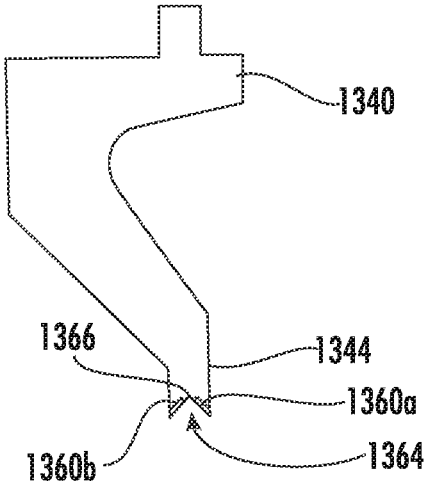
FIG. 13A shows a further alternative embodiment of the punch body of FIGS. 2-6.
Figure 13B:
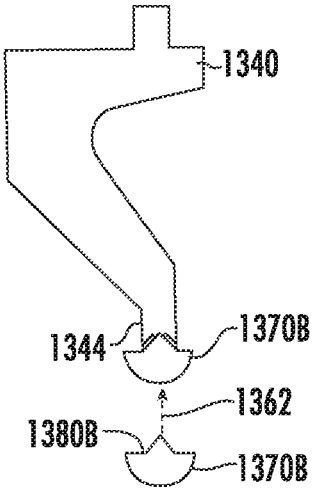
FIG. 13B shows the punch body of FIG. 13A with a first interchangeable tip.
Figure 13C:
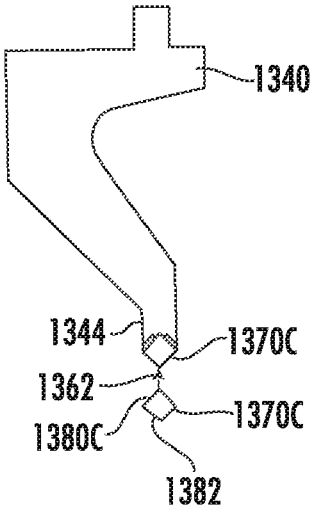
FIG. 13C shows the punch body of FIG. 13A with a second interchangeable tip.
Figure 13D:
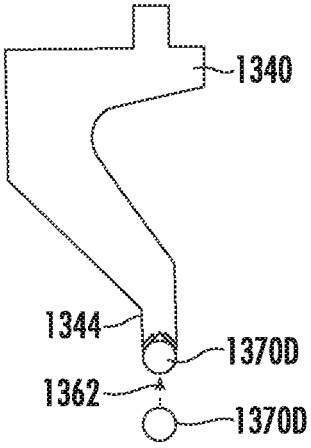
FIG. 13D shows the punch body of FIG. 13A with a third interchangeable tip.

With reference now to FIG. 13A, a punch body 1340 is shown wherein the distal end 1344 of the punch body 1340 includes an angled groove 1364. The front and rear sides of the groove 1364 are angled inwardly and upwardly and meet at an apex 1366. In other words, the cross-section of the groove 1364 has an arrow-like shape pointing upward. Magnets 1360*a* and 1360*b* are provided on each side of the ridge 1164. The magnets are oriented at an angle relative to one another (e.g., at a ninety degree angle) with a group of first magnets 1360*a* aligned along the front side of the groove 1364, and a group of second magnets 1360*b* aligned along the back side of the groove 1364. As shown in FIG. 13B a first tip 1370B has a truncated circular or oval shaped cross-section and a ridge 1380B formed opposite the curved portion. The ridge 1380B is complementary to the groove 1364 and configured to be inserted into and received by the groove 1364 when the tip 1370B is aligned with and moved toward the punch body 1340 in the vertical direction as noted by arrow 1362. FIG. 13C shows a second tip 1370C having a substantially square cross-sectional shape. Accordingly, the second tip 1370C is generally shaped as a rod-like structure having a substantially square cross-section. The tip 1370C includes a working surface 1382 that has a slightly rounded edge, and an opposite ridge 1380C. The ridge 1380C is complementary to the groove 1364 and configured to be inserted into and received by the groove 1364 when the tip 1370C is aligned with and moved toward the punch body 1340 in the vertical direction as noted by arrow 1362. FIG. 13D shows a third tip 1370D having a substantially round cross-section. Accordingly, the third tip 1370D is generally shaped as a rod-like structure having a substantially round cross-section. Any portion of the rod may serve as the working surface for the tip 1370D, and the opposite side of the tip is received within the groove 1364.

With reference now to FIGS. 14A-16D, several additional alternative embodiments of a punch body and interchangeable punch tips are shown. In each of the embodiments of FIGS. 14A-16D, the punch bodies are different, the punch tips are different, and/or the coupling arrangement between the punch body and the punch tips is different. It will be recognized that in each of the embodiments of FIGS. 14A-16D, the punch bodies and tips are similar to those described above, including those of FIGS. 10A-13D, but are somewhat differently configured. Accordingly, certain details concerning the punch bodies and punch tips of FIGS. 14A-16D have not been repeated herein for the sake of brevity, and it will be recognized that such details from previously described embodiments may also apply to the embodiments of FIGS. 14A-16D, unless explained differently herein.

Figures 14A, 14B, 15A, 15B:
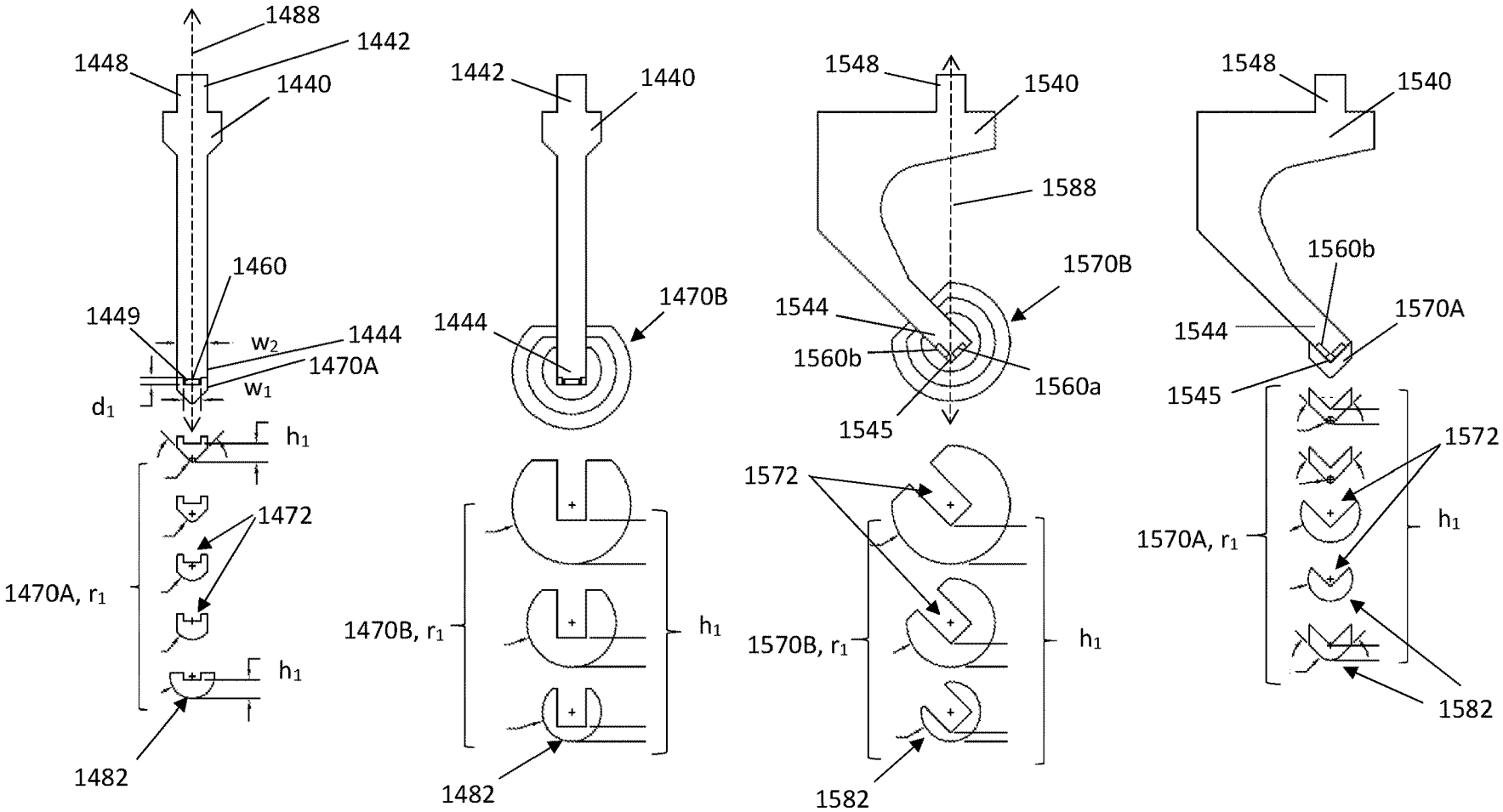
FIG. 14A shows a cross-sectional view of an alternative embodiment of the punch body of FIGS. 11A-11C with a first set of interchangeable tips.
FIG. 14B shows a cross-sectional view of the punch body of FIG. 14A with a second set of interchangeable tips.
FIG. 15A shows a cross-sectional view of another alternative embodiment of the punch body of FIGS. 11A-11C with a first set of interchangeable tips.
FIG. 15B shows a cross-sectional view of the punch body of FIG. 15A with a second set of interchangeable tips.

With particular reference now to FIG. 14A, a punch body 1440 is shown. The punch body 1440 is generally linear in cross-sectional shape from the proximal end 1442 to the distal end 1444. In other words, unlike the punch bodies of FIGS. 10A-13D, the punch body 1440 of FIG. 14A does not include a recessed portion (e.g., a C-shaped portion) that curves away from an axial centerline 1488 that is substantially parallel to the punch direction. The linear nature of the punch body 1440 of FIG. 14A results in the axial centerline 1488 extending directly through the middle of the flange 1448 on the proximal end and a lip 1449 of the distal end. The lip 1449 includes a rectangular protuberance that extends outward from a shoulder on the distal end by a distance $d_1$. The shoulder is defined between a width $w_1$ of the protuberance and a width $w_2$ defined prior to (i.e., on the proximal side of) the protuberance. In one embodiment, the width $w_2$ is approximately 0.50 inches, the width $w_1$ is approximately 0.3125 inches, and the distance $d_1$ is 0.125 inches. However, in other embodiments, the measurements of $w_1$, $w_2$ and $d_1$ may be significantly different. A magnet 1460 is embedded in the lip. The magnet 1460 generally has a depth that is approximately the same as $d_1$ and a width that slightly less than $w_1$. Together, the shoulder, the rectangular protuberance, and the magnet 1460 are configured to help retain tips 1470A on the distal end of the punch body 1440.

A number of interchangeable tips 1470A are shown in FIG. 14A. Each of the interchangeable tips 1470A are defined by a radius $r_1$ on a distal/working surface 1482 and a groove 1472 on the opposite/proximal side. The groove 1472 has a depth approximately the same as $d_1$, and a width approximately the same as $w_1$. Each tip 1470A extends a distance/height $h_1$ from the bottom of the groove 1472 to the distal end of the tip (i.e., the distal-most portion at radius $r_1$). Five exemplary interchangeable tips 1470A are shown in FIG. 14A, each with the same distance $h_1$, but a progressively greater radius $r_1$, as shown in the figure. The radius $r_1$ defines a distal-most portion of the working surface 1482. When the radius $r_1$ is relatively small, the working surface 1482 of the tip 1470A is generally V-shaped with angled forward and rear sidewalls and a curved surface defined by the radius $r_1$ positioned in-between. When the radius $r_1$ is relatively large, the working surface 1482 is defined entirely by the radius $r_1$. Each of these tips 1470A is configured to be removably secured on the distal end of the punch body 1440 and retained in place by the combination of the magnet 1460 and the interlocking shapes formed at the junction of the tip and punch body.

FIG. 14B shows the same punch body 1440 of FIG. 14A, but with additional tips 1470B that may be used with the punch body 1440. Each tip 1470B includes a groove 1472 having a depth that is significantly greater than $d_1$, and a width approximately the same as but slightly greater than $w_2$. As such, the entire distal end of the punch body 1440 may be inserted into one of the tips 1470B. Three exemplary interchangeable tips 1470B are shown in FIG. 14B, each with a progressively smaller distance $h_1$, and a progressively smaller radius $r_1$, as shown in the figure. Each of these tips 1470 is configured to be removably secured on the distal end of the punch body 1440 and retained in place by the combination of the magnet 1460 and the complimentary shapes of the punch body and tip. The complete insertion of the distal end of the punch body into the tip assists in further securing the tip to the punch body in the embodiment of FIG. 14B.

FIG. 15A and FIG. 15B illustrate two additional embodiments of a punch body 1540 and tip 1570A, 1570B combination. The punch body in FIGS. 15A and 15B is similar to that described above in association with FIGS. 11A-11C, including a tapered distal end 1544 that includes a "V" shaped distal surface including a downward pointing lateral ridge 1545 formed between two opposing sides of the distal surface. The two opposing sides of the distal surface face different directions and include a front surface portion (which may also be referred to herein as a "front side" or "front sidewall" of the distal surface) and a rear surface portion (which may also be referred to herein as a "rear side" or "rear sidewall" of the distal surface). In the embodiment of FIGS. 15A and 15B, the opposing sidewalls of the V-shaped distal surface are generally angled at a right angle (i.e., between 88° and 92°), and in at least some embodiments form an angle between 60° and 120°. The flange 1548 of punch body 1540 is directly aligned over the downward facing lateral ridge 1545. An axial centerline 1588 extends downward through the flange 1548 and is parallel to the punch direction. Because the flange 1548 is directly aligned over the lateral ridge, the axial centerline 1588 also extends through the downward facing lateral ridge 1545 of the V-shaped distal surface. In other embodiments, the lateral ridge 1545 may be slightly offset from the axial centerline 1588 by a small distance (e.g., the lateral ridge 1545 is 0-5 mm from the axial centerline.

Magnets 1560*a* and 1560*b* are provided on each side of the ridge 1545 with one side flush against the V-shaped distal surface of the punch body 1540. Thus, each magnet 1560*a* includes one side that is flush against the front side of the V-shaped distal surface (i.e., faces the same direction as the front side of the distal surface), and each magnet 1560*b* includes one side that is flush against the rear surface portion of the V-shaped distal surface (i.e., faces the same direction as the rear side of the distal surface). For example, each forward magnet 1560*a* may be oriented with its north-pole side (or alternatively, south-pole side) facing the same direction as the front sidewall of the distal surface, and each rear magnet 1560*b* may be oriented with its north-pole side (or alternatively, south-pole side) facing the same direction as the rear sidewall of the distal surface. Thus, similar to the V-shaped distal surface of the punch body 1540, the magnets 1560*a* and 1560*b* are oriented at an angle relative to one another (e.g., at a ninety degree angle) with a group of first magnets 1560*a* aligned along the front side of the V-shaped distal surface and facing a first direction, and a group of second magnets 1560*b* aligned along the back side of the V-shaped distal surface and facing a second direction. In the embodiments disclosed herein, the magnets 1560*a* and 1560*b* generally have a cubic or other rectangular prism shape. However, in other embodiments, the magnets 1560*a* and 1560*b* may have other shapes, such as cylindrical shapes.

The tips 1570A shown in FIG. 15A are similar to those shown in FIG. 14A but, instead of the rectangular groove 1472 of the tips 1470A of FIG. 14A, each tip 1570A includes a V-shaped groove 1572 that is an opposing surface from the working surface 1582. Each V-shaped groove is also complementary to the V-shaped distal end of the punch body 1540 such that the surface of the V-shaped groove 1572 receives and engages the surface on the tapered distal end 1544 of the punch body. In other words the V-shaped distal end of the punch body 1540 nests within the V-shaped groove 1572 of each tip. The tips 1570B shown in FIG. 15B are the same as those shown in FIG. 14B, and may be used interchangeably with the punch bodies 1440 and 1540. These tips 1570B also include a groove that acts as a V-shaped groove 1572 when the tip is engaged with the punch body 1540 because the tip 1570B is rotated such that the bottom of the groove 1572 is V-shaped rather than square (as shown in FIG. 14B). The shape of the groove 1572 of the tips 1570B is also complementary to the distal end 1544 of the punch body 1540, as the distal end 1544 nests within the groove 1572.

Advantageously, the punch body 1540 of FIGS. 15A and 15B facilitates retention of the tips 1570A and 1570B on the punch body 1540. The V-shaped distal surface of the punch body 1540 allows the tips 1570A and 1570B to be held in place by the magnets 1560*a* and 1560*b* along two faces of contact (i.e., the forward and rearward faces along opposite sides of the lateral ridge 1545), without the assistance of clamping or additional components. The magnetic coupling between the punch body 1540 and the tips 1570A and 1570B allows for the serial use of multiple tips 1570 on the punch body 1540 without the need for releasing and reinstalling any clamps, securing mechanisms or other tools when changing tips on the punch body 1540. Instead, when changing the tips 1570A or 1570B on the punch body 1540, an operator simply slides an existing tip off the distal end of the punch body and brings a second tip into proximity of the distal end until the magnets 1560*a* and 1560*b* engage the tip and secure it to the punch body 1540. This greatly simplifies the tip-changing process. Furthermore, the V-shaped distal surface also provides the advantage of precise centering of the tips 1570A and 1570B on the punch body 1540 (i.e., along the axial centerline 1588) due at least in part to the opposing magnets on opposite sides of the V-shaped distal surface. The V-shaped distal surface of the punch body 1540 also allows for the use of finer tips (e.g., tips with a smaller radius $r_1$ defined along the distal ridge 1545). Moreover, because the V-shaped design of the punch body 1540 does not rely on a slip fit of a tongue of the tip into a groove of the punch body, the possibility of side-to-side play of the tip is greatly reduced. This side-to-side play is undesirable because it can lead to eventual wear or spreading of the grooves.

Figure 16A:
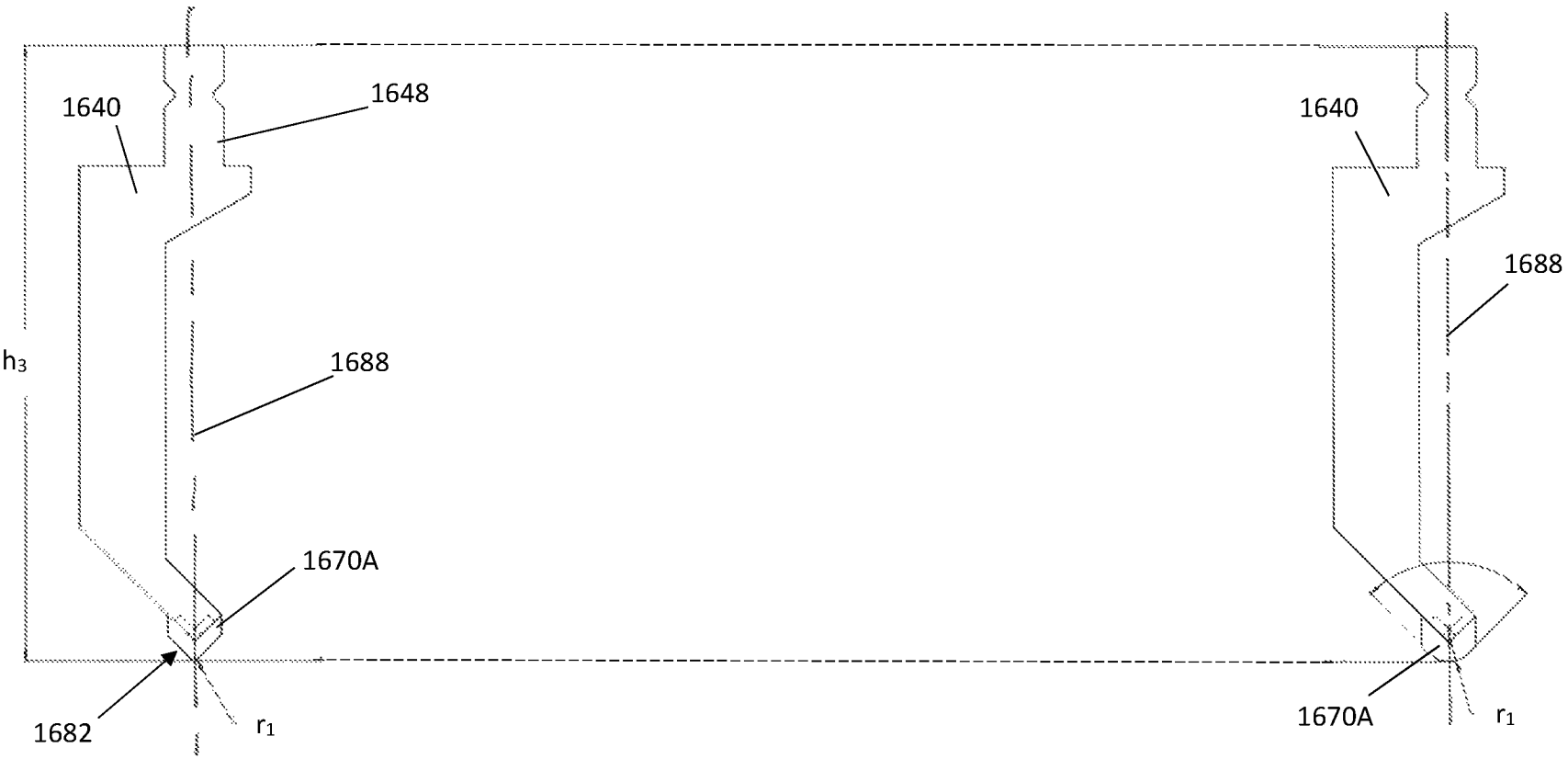
FIG. 16A shows yet another cross-sectional view of an alternative embodiment of the punch body of FIGS. 11A-11C with a first set of interchangeable tips.
Figure 16B:
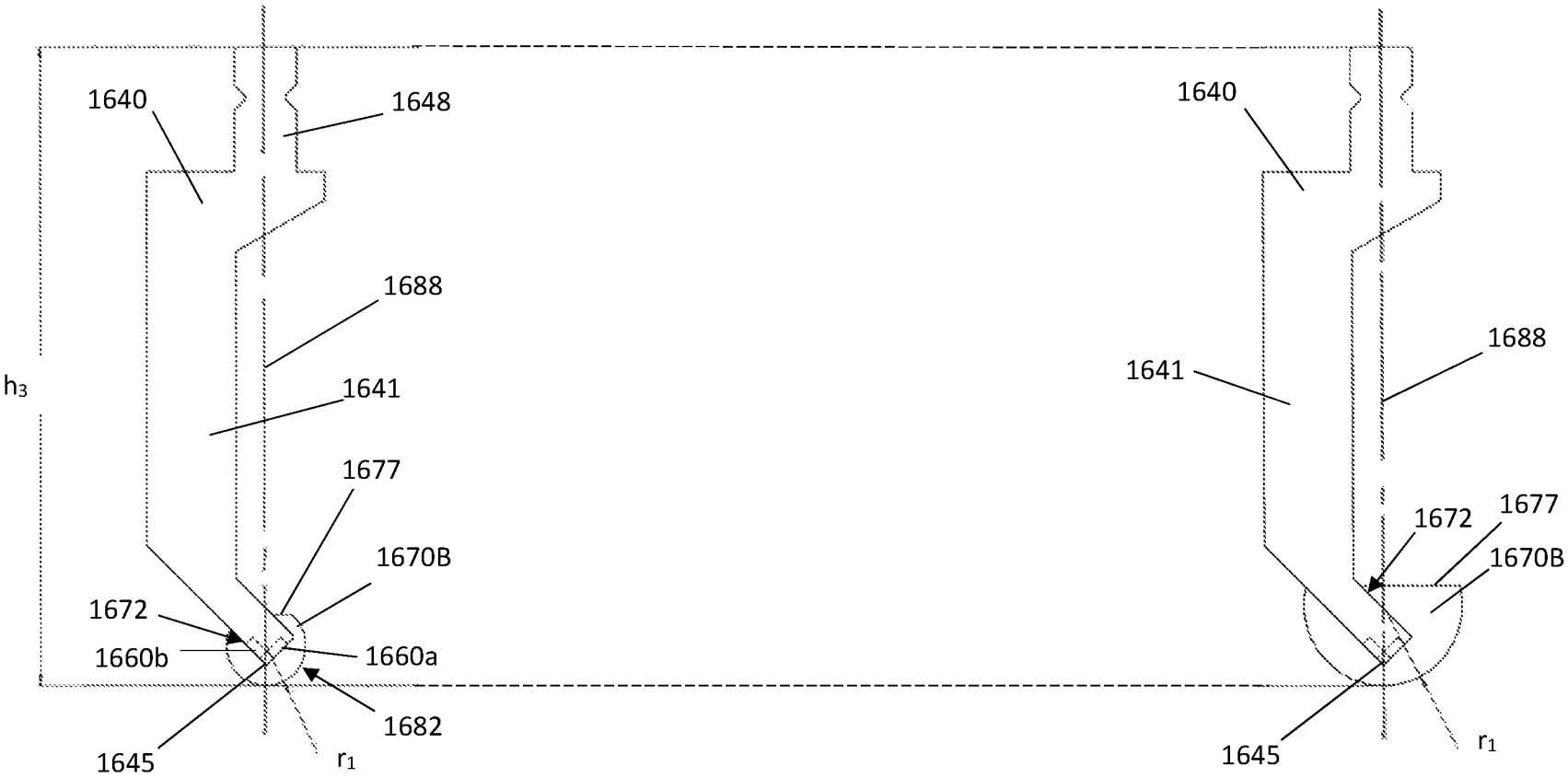
FIG. 16B shows a cross-sectional view of the punch body of FIG. 16A with a second set of interchangeable tips.

With reference now to FIGS. 16A and 16B, an additional embodiment of a punch body 1640 and tip 1670A, 1670B combination is shown. Two punch bodies 1640 and two tips 1670 are shown in each of FIGS. 16A and 16B. Each punch body 1640 in FIGS. 16A and 16B is similar to the punch body 1540 described above in association with FIGS. 15A and 15B. Accordingly, each punch body 1640 includes a proximal flange 1648 that is directly aligned over the downward facing lateral ridge 1645 such that the axial centerline 1688 extends directly through the lateral ridge 1645 as well as the center of the proximal flange 1648. Each punch body 1640 of FIGS. 16A and 16B includes a smaller C-shaped central portion 1641 than that of punch body 1540. In other words, the contours of the punch body 1640 deviate from the axial centerline 1688 to a lesser extent in FIGS. 16A and 16B than in the embodiment of FIGS. 15A and 15B. Magnets 1660*a* and 1660*b* are provided on each side of the ridge 1645. The magnets are oriented at an angle relative to one another (e.g., at a ninety degree angle) with a group of first magnets 1660*a* aligned along the front side of the ridge, and a group of second magnets 1660*b* aligned along the back side of the ridge.

The two tips 1670A shown in FIG. 16A are similar to those shown in FIG. 15A, and may be used interchangeably with the punch body 1540. As shown in FIG. 16A, although the radius $r_1$ of the tips 1670A of FIG. 16A are different, the overall height $h_3$ of the tip 1670A and punch body 1640 combination remains the same because the height ($h_1$) from the bottom of the groove to the working surface 1682 of the tip is the same for each of the tips 1670A. The two tips 1670B shown in FIG. 16B are similar to those shown in FIG. 15B, and may be used interchangeably with the punch body 1540. However, the tips 1670B only include a shoulder 1677 on one side of the groove 1672, and the radius of the tip 1670B on the opposite side extends completely to the groove 1672. Again, as shown in FIG. 16B, although the radius $r_1$ of the tips 1670B of FIG. 16B are different, the overall height $h_3$ of the tip 1670B and punch body 1640 combination remains the same because the height ($h_1$) from the bottom of the groove to the edge of the tip is the same for each of the tips 1670B. It will be appreciated that the punch body 1640 including a V-shaped distal surface and complementary tips of FIGS. 16A and 16B provides the same advantages as those described above in association with the punch body 1540 and complementary tips of FIGS. 15A and 15B.

The foregoing are but a few of the possible alternative embodiments of the punch assembly with interchangeable tips described herein. It will be recognized that numerous additional embodiments are also possible. For example, while FIGS. 15A-16B show a punch body with a downward pointing V-shaped distal surface, in at least some embodiments, the V-shaped distal surface may be upward pointing (i.e., the ridge of the V may be formed within a recess of the distal surface, such as that shown in FIGS. 13A-13D). As another example, instead of a plurality of magnets being provided on both the front side and rear side of the distal surface as explained in various embodiments above, in at least one alternative embodiment only one magnet is provided on the front side of the distal surface and only one magnet is provided on the rear side of the distal surface.

Figure 17:
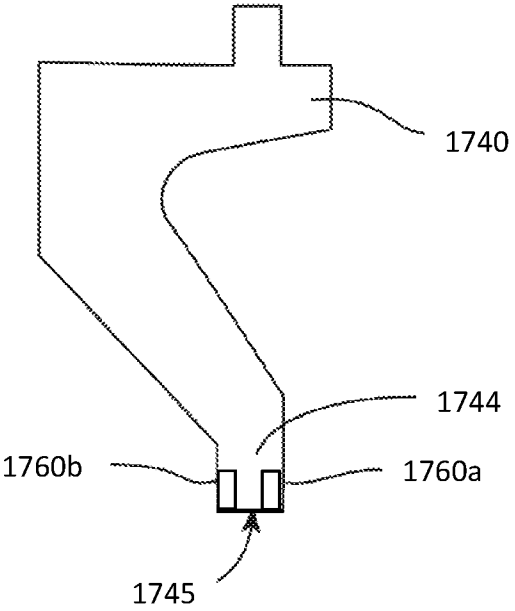
FIG. 17 shows a cross-sectional view of an alternative embodiment of the punch body of FIG. 10A.

FIG. 17 shows yet another alternative embodiment of the punch body. The punch body of FIG. 17 is similar to that of FIGS. 15A-16B, but instead of a V-shaped distal surface, a rectangular distal surface 1745 is provided on the distal end 1744 of the punch body 1740. The rectangular distal surface 1745 includes a front side portion, a bottom side portion, and a rear side portion, wherein the front side portion is parallel to the rear side portion. Advantageously, magnets 1760*a* and 1760*b* are embedded in the distal end 1744 and provided on both the front side and the rear side of the rectangular distal surface. In particular, the first magnet 1760*a* includes one side that is flush with the front side portion and the second magnet 1760*b* includes one side that is flush with the rear side portion. Similar to the punch body with a V-shaped distal surface, the punch body 1740 of FIG. 17 includes opposing magnets 1760*a*, 1760*b* on opposite sides of the distal surface 1745 that act to secure tips having complementary grooves to the distal surface 1745 in place during use of the punch assembly. The opposing magnets 1760*a*, 1760*b* also facilitate precise centering of the tips. Similar to the embodiments of FIGS. 15A-16B, when used with complementary tips, no additional clamping, coupling mechanisms or tools are required when the operator changes tips on the punch body 1740.

In addition to the foregoing, it will be recognized that numerous other alternative embodiments are also possible. Furthermore, aspects of the various embodiments described herein may be combined or substituted with aspects from other features to arrive at different embodiments from those described herein. Thus, it will be appreciated that several of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A punch set comprising:

a plurality of punch bodies, each punch body of the plurality of punch bodies including a proximal end and a distal end opposite the proximal end, the proximal end including a flange configured to engage a punch holder, the distal end defining a distal surface extending along a lateral direction on said punch body, the distal surface including a front surface portion and a rear surface portion, the front surface portion facing a different direction than the rear surface portion;

a plurality of magnets embedded in the distal end of each punch body of the plurality of punch bodies, the plurality of magnets including at least one first magnet and at least one second magnet, the at least one first magnet facing the front surface portion of the distal surface and the at least one second magnet facing the rear surface portion of the distal surface; and a plurality of punch tips configured to interchangeably and releasably engage the distal end of each punch body of the plurality of punch bodies, each of the punch tips of the plurality of punch tips having a working surface and an opposing surface, the opposing surface configured to engage the distal surface of one punch body of the plurality of punch bodies such that the opposing surface of the punch tip extends at least to the plurality of magnets embedded in said punch body, wherein the distal surface of said one punch body is a V-shaped surface such that the front surface portion is angled relative to the rear surface portion and defines a vertex that points in a press direction, the press direction defined along an axis that extends from the proximal end to the distal end of said one punch body and is perpendicular to the lateral direction.

2. The punch set of claim 1 wherein the opposing surface of each punch tip forms a groove such that the distal end of said one punch body nests within the groove and the plurality of magnets are cupped within the groove when the opposing surface of said punch tip engages the distal surface of said one punch body.

3. The punch set of claim 1 wherein the vertex is provided along a downward facing lateral ridge defined by a radius.

4. The punch set of claim 1 wherein the working surface of each punch tip is defined by a shape, and wherein the shape of the working surface of each punch tip is different than the shape of the working surface of other punch tips of the plurality of punch tips.

5. The punch set of claim 1 wherein the plurality of magnets are embedded in bores formed in the distal end of each punch body.

6. The punch set of claim 1 wherein each punch body and each punch tip is comprised of steel.

7. A punch set comprising:

a plurality of punch bodies, each punch body of the plurality of punch bodies including a proximal end and a distal end opposite the proximal end, the proximal end including a flange configured to engage a punch holder, the distal end defining a distal surface extending along a lateral direction on said punch body, the distal surface including a front surface portion and a rear surface portion, the front surface portion facing a different direction than the rear surface portion, wherein the distal surface is a rectangular surface further including a bottom surface portion positioned between the front surface portion and the rear surface portion, wherein the front surface portion is parallel to the rear surface portion, and wherein a press direction is defined along an axis that extends from the proximal end to the distal end of said punch body and is perpendicular to the lateral direction and the bottom surface portion;

a plurality of magnets embedded in the distal end of each punch body of the plurality of punch bodies, the plurality of magnets including at least one first magnet and at least one second magnet, the at least one first magnet facing the front surface portion of the distal surface and the at least one second magnet facing the rear surface portion of the distal surface; and a plurality of punch tips configured to interchangeably and releasably engage the distal end of each punch body of the plurality of punch bodies, each punch tip of the plurality of punch tips having a working surface and an opposing surface, the opposing surface configured to engage the distal surface of one punch body of the plurality of punch bodies such that the opposing surface of the punch tip extends at least to the plurality of magnets embedded in said one punch body.

8. A punch assembly comprising:

a punch body including a proximal end, a distal end opposite the proximal end, the proximal end including a flange configured to engage a punch holder, the distal end includes a distal surface extending along a lateral direction on the punch body, the distal surface including a first surface portion and a second surface portion wherein the first surface portion faces a first direction and the second surface portion faces a second direction that is different than the first direction and the lateral direction, wherein the distal surface of the punch body is a V-shaped surface such that the first surface portion is angled relative to the second surface portion and defines a vertex that points in a press direction, the press direction defined along an axis that extends from the proximal end to the distal end of the punch body and is perpendicular to the lateral direction; and a punch tip coupled to the distal end of the punch body via a magnetic coupling provided by a plurality of magnets, the plurality of magnets including at least one first magnet defining a pole-side facing the first direction.

9. The punch assembly of claim 8 wherein the vertex is defined by a first radius, and wherein the punch tip includes a distal working surface and a proximal opposing surface forming a groove, wherein the distal end of the punch body is nested within the groove formed by the opposing surface of the punch tip.

10. The punch assembly of claim 9 wherein the distal working surface of the punch tip is defined by a second radius.

11. The punch assembly of claim 9 wherein the groove formed by the opposing surface of the punch tip is complementary in shape to the distal end of the punch body.

12. The punch assembly of claim 8 wherein the plurality of magnets are permanent magnets.

13. The punch assembly of claim 12 wherein the plurality of magnets are embedded in bores formed in the distal end of the punch body.

14. The punch assembly of claim 8 wherein the punch body and the punch tip are comprised of steel.

15. The punch assembly of claim 8 wherein each magnet of the plurality of magnets is defined by a first pole side and an opposite second pole side, wherein the first pole side of the at least one first magnet faces the first direction, the plurality of magnets further including at least one second magnet with the first pole side facing the second direction.

16. A method of bending a workpiece comprising:

securing a punch body to a punch holder, the punch body including a proximal end and a distal end opposite the proximal end, the distal end defining a distal surface extending in a lateral direction on the punch body, the distal surface including a front surface portion facing a first direction and a rear surface portion facing a second direction different from the first direction, wherein the front surface portion and the rear surface portion extend downwardly and meet at a downward facing lateral ridge, wherein a press direction is defined perpendicular to the lateral direction, and wherein the first direction is different than the press direction;

coupling a first punch tip to the distal end of the punch body using a magnetic coupling between the first punch tip and the punch body, the magnetic coupling provided at least in part by at least one first magnet having a pole side that faces the first direction, the first punch tip having a working surface and an opposing surface defining a cavity configured to engage the downward facing lateral ridge on the distal end of the punch body;

when the first punch tip is coupled to the punch body by the magnetic coupling, moving the punch body and the coupled first punch tip in the press direction such that the working surface of the first punch tip engages a workpiece;

bending the workpiece during engagement with the first punch tip; and moving the punch body and the coupled first punch tip in a direction opposite the press direction such that the working surface of the first punch tip disengages the workpiece.

17. The method of claim 16 wherein the distal surface of the punch body is a V-shaped surface such that the front surface portion is angled relative to the rear surface portion and defines a vertex that points in the press direction, and wherein the magnetic coupling is provided using at least one first magnet that faces the first direction and at least one second magnet that faces the second direction.

18. The method of claim 16 further comprising:

removing the first punch tip from the punch body in order to de-couple the first punch tip from the punch body; and magnetically coupling a second punch tip to the distal end of the punch body, the second punch tip having a working surface and an opposing surface configured to engage the distal end of the punch body.

19. The method of claim 18 wherein the working surface of the second punch tip is shaped differently than the working surface of the first punch tip.

20. A punch assembly configured to bend a workpiece, the punch assembly comprising:

a monolithic punch body including a proximal end and a distal end opposite the proximal end, the proximal end including a flange configured to engage a punch holder, the distal end including a distal surface extending along a lateral direction on the punch body, the distal surface longer in the lateral direction than in a direction perpendicular to the lateral direction; and a punch tip releasably coupled to the distal end of the punch body via a magnetic coupling provided by a plurality of magnets, the punch tip engaging the monolithic punch body in a tongue-in-groove arrangement wherein the plurality of magnets are embedded in the tongue-in-groove arrangement, wherein the distal end of the punch body provides a tongue portion of the tongue-in-groove arrangement, and wherein the punch tip provides a groove portion of the tongue-in-groove arrangement.

* * * * *